US009014590B2

(12) United States Patent
Nishimura et al.

(10) Patent No.: US 9,014,590 B2
(45) Date of Patent: Apr. 21, 2015

(54) CLEANING MEMBER, CHARGING DEVICE ASSEMBLY, AND IMAGE FORMING APPARATUS

(71) Applicant: Fuji Xerox Co., Ltd., Tokyo (JP)

(72) Inventors: Makoto Nishimura, Kanagawa (JP); Takeshi Kawai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/889,723

(22) Filed: May 8, 2013

(65) Prior Publication Data

US 2014/0099141 A1 Apr. 10, 2014

(30) Foreign Application Priority Data

Oct. 5, 2012 (JP) ..... 2012-223527

(51) Int. Cl.
*G03G 15/02* (2006.01)
*G03G 21/00* (2006.01)

(52) U.S. Cl.
CPC .... *G03G 21/0058* (2013.01); *G03G 2221/0089* (2013.01); *G03G 15/0225* (2013.01)

(58) Field of Classification Search
CPC ..... G03G 15/0225; G03G 15/0258; G03G 15/166; G03G 15/168; G03G 15/2025; G03G 15/2075; G03G 21/0058; G03G 2215/1647; G03G 2215/1652; G03G 2215/1657; G03G 2215/1661; G03G 2215/02; G03G 2221/0089
USPC ..... 399/100, 101, 326, 357; 15/230.13, 15/256.52
See application file for complete search history.

(56) References Cited

U.S. PATENT DOCUMENTS

| | | | | |
|---|---|---|---|---|
| 8,320,790 | B2 * | 11/2012 | Yamaguchi | 399/99 |
| 8,467,697 | B2 * | 6/2013 | Kawai et al. | 399/100 |
| 8,515,304 | B2 * | 8/2013 | Hagiwara et al. | 399/100 |
| 8,515,305 | B2 * | 8/2013 | Nonaka et al. | 399/100 |
| 8,538,287 | B2 * | 9/2013 | Kawai | 399/100 |
| 8,755,710 | B2 * | 6/2014 | Aoyagi et al. | 399/100 |
| 2011/0170897 | A1 | 7/2011 | Hagiwara et al. | |

FOREIGN PATENT DOCUMENTS

| | | | |
|---|---|---|---|
| JP | A-2006-276404 | | 10/2006 |
| JP | A-2010-060997 | | 3/2010 |
| JP | 2010286713 | A * | 12/2010 |
| JP | 2011145413 | A * | 7/2011 |
| JP | A-2011-145415 | | 7/2011 |
| JP | 2011191677 | A * | 9/2011 |
| JP | A-2011-203569 | | 10/2011 |

* cited by examiner

*Primary Examiner* — Robert Beatty
(74) *Attorney, Agent, or Firm* — Oliff PLC

(57) ABSTRACT

A cleaning member includes a shaft body and a spiral portion including a contact portion that is formed on an outer peripheral surface of the shaft body, protrudes spirally, and comes into contact with a body to be cleaned with the rotation of the shaft body, steps that are formed on the contact portion and face a rotation direction of the shaft body and an end portion that is positioned on a side where the contact portion comes into contact with the body to be cleaned first in a width direction of the contact portion and of which the height from the shaft body is gradually reduced from the height of the contact portion so that the end portion does not come into contact with the body to be cleaned.

11 Claims, 12 Drawing Sheets

CLEANING MEMBER, CHARGING DEVICE ASSEMBLY, AND IMAGE FORMING APPARATUS

CROSS-REFERENCE TO RELATED APPLICATIONS

This application is based on and claims priority under 35 USC 119 from Japanese Patent Application No. 2012-223527 filed Oct. 5, 2012.

BACKGROUND

Technical Field

The present invention relates to a cleaning member, a charging device, an assembly, and an image forming apparatus.

SUMMARY

According to an aspect of the invention, there is provided a cleaning member including a shaft body and a spiral portion including a contact portion that is formed on an outer peripheral surface of the shaft body, protrudes spirally, and comes into contact with a body to be cleaned with the rotation of the shaft body, steps that are formed on the contact portion and face a rotation direction of the shaft body, and an end portion that is positioned on a side where the contact portion comes into contact with the body to be cleaned first in a width direction of the contact portion and of which the height from the shaft body is gradually reduced from the height of the contact portion so that the end portion does not come into contact with the body to be cleaned.

BRIEF DESCRIPTION OF THE DRAWINGS

Exemplary embodiments of the present invention will be described in detail based on the following figures, wherein.

DETAILED DESCRIPTION

Figure 1:
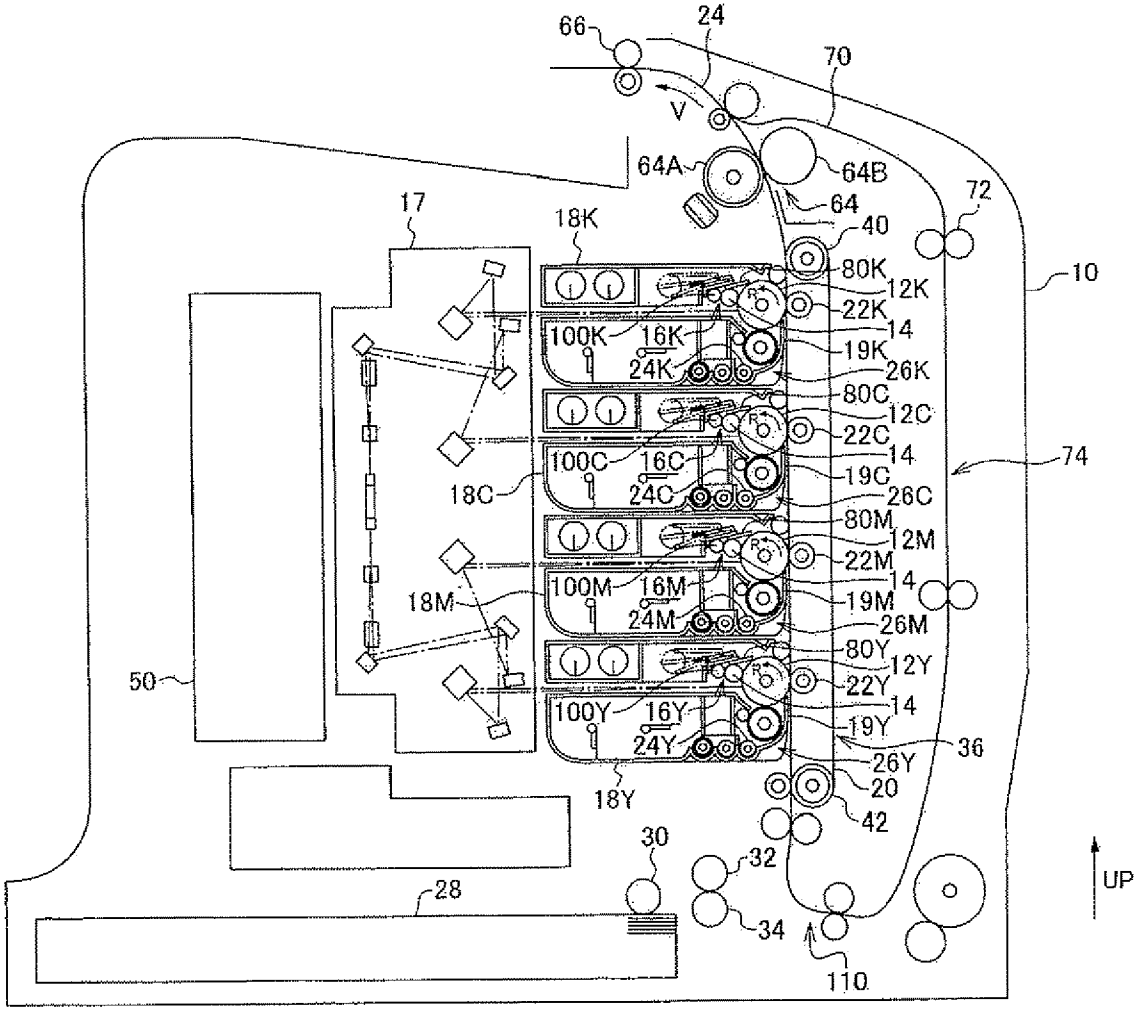
FIG. 1 is a view showing the entire configuration of an image forming apparatus according to an exemplary embodiment of the invention.

Examples of a cleaning member, a charging device, a process cartridge, and an image forming apparatus according to exemplary embodiments of the invention will be described below with reference to the drawings. First of all, the entire configuration of the image forming apparatus will be described. Next, the image formation of the image forming apparatus will be described. After that, the charging device will be described and the cleaning member of the charging device will be described. Meanwhile, an arrow UP in the drawing represents the upper side in the vertical direction.

Entire Configuration of Image Forming Apparatus

Entirety

FIG. 1 shows an image forming apparatus 10 as an example of an image forming apparatus that includes a cleaning member, a charging device, and a process cartridge according to exemplary embodiments of the invention.

A recording medium accommodating unit 28 that accommodates sheet members P as an example of recording media, an image forming section 110 that forms an image on the sheet member P, transport rollers 32 and 34 that transport the sheet member P to the image forming section 110 from the recording medium accommodating unit 28, a recording medium transporting path 74 along which the sheet member P is reversed so that an image is formed on the back of the sheet member after an image is formed on the surface of the sheet member P, and a controller 50 that controls the operations of the respective sections of the image forming apparatus 10 are provided in the image forming apparatus 10.

Image Forming Section

The image forming section 110 includes a latent image forming device (exposure device) 17 that emits light beams corresponding to color toners, that is, a yellow (Y) toner, a magenta (M) toner, a cyan (C) toner, and a black (K) toner to photoreceptor drums 12Y, 12M, 12C, and 12K as an example of an image supporting body; process cartridges 18Y, 18M, 18C, and 18K that form color toner images, that is, a yellow (Y) toner image, a magenta (M) toner image, a cyan (C) toner image, and a black (K) toner image; a transfer device 36 that transfers the respective color toner images, which are formed by the process cartridges 18Y, 18M, 18C, and 18K, to the sheet member P; and a fixing device 64 that fixes the color toner images, which have been transferred to the sheet member P, to the sheet member P.

Meanwhile, in the following description, any one of Y, M, C, and K is added to the end of the reference numeral when Y, M, C, and K need to be distinguished from each other, and Y, M, C, and K added to the ends of the reference numerals will be omitted when Y, M, C, and K do not need to be distinguished from each other.

Latent Image Forming Device

The latent image forming device 17 is adapted to emit light beams, which correspond to electrostatic latent images, to the surfaces of the photoreceptor drums 12 on the basis of exposure signals that are sent from the controller 50.

Process Cartridge

The process cartridges 18 are detachably mounted on the image forming apparatus 10. The respective process cartridges 18 are disposed side by side in a vertical direction. Each of the process cartridges 18 includes a photoreceptor drum 12 that rotates in a direction of an arrow R.

Each of the process cartridges 18 includes a charging device 16, a developing device 26, and a removal device 80 that are disposed around the photoreceptor drum 12 in this order from the upstream side of the photoreceptor drum 12. The charging device 16 charges the surface of the photoreceptor drum 12. The developing device 26 forms a toner image by developing an electrostatic latent image, which is formed by the light beam emitted from the latent image forming device 17, with each color toner. The removal device 80 removes the toner that remains on the surface of the photoreceptor drum 12 after the toner image formed on the photoreceptor drum 12 is transferred to the sheet member P.

Meanwhile, the process cartridge 18 is an example of an assembly that is assembled into the image forming apparatus so as to be capable of being integrally replaced.

Photoreceptor Drum

The photoreceptor drum 12 includes a cylinder that is made of aluminum, and a photosensitive layer that is formed by forming an undercoat layer, a charge generation layer, and a charge transport layer on the cylinder in this order. The photoreceptor drum 12 exhibits the properties of an insulator when being charged by the charging device 16, and exhibits the properties of a semiconductor when a light beam emitted from the latent image forming device 17 enters the photoreceptor drum 12. The surface of the photoreceptor drum 12 is charged by the charging device 16, and a latent image is formed on the surface of the photoreceptor drum 12 by the latent image forming device 17.

Charging Device

The charging device 16 includes a charging roller 14 as an example of a charging member (a body to be cleaned) and a cleaning roller 100 as an example of a cleaning member. The surface of the photoreceptor drum 12 is charged by bringing the charging roller 14, to which a voltage has been applied, into contact with the surface of the photoreceptor drum 12. Further, the cleaning roller 100 is to remove foreign materials, such as toner, external additives, and paper powder, which adhere to the surface of the charging roller 14. The charging device 16 and the cleaning roller 100 will be described in detail below.

Developing Device

The developing device 26 includes a developer supplier 19 that supplies a toner to the photoreceptor drum 12 and a transport member 24 that transports the toner while agitating the toner supplied to the developer supplier 19.

Removal Device

The removal device 80 is to remove the toner that remains without being transferred to the surface of the photoreceptor drum 12. The removal device 80 is formed of a blade that is made of rubber.

Transfer Device

The transfer device 36 includes a recording medium transport belt 20, a support roller 40 and a driving roller 42 that are provided on the inner peripheral surface of the recording medium transport belt 20 and apply tension to the recording medium transport belt 20 to rotate the recording medium transport belt 20, and transfer rollers 22 that transfer the toner images formed on the respective photoreceptor drums 12 to the sheet member P to be transported. The surface side of the recording medium transport belt 20 comes into contact with the outer peripheral surfaces of the respective photoreceptor drums 12 that are arranged side by side in the vertical direction, and the back side of the recording medium transport belt 20 with which the outer peripheral surfaces of the respective photoreceptor drums 12 come into contact is pressed by the respective transfer rollers 22.

Fixing Device

The fixing device 64 is disposed on the downstream side of the transfer device 36 in a transport direction V of the sheet member P. The fixing device 64 includes a fixing roller 64A and a pressure roller 64B. The toner images, which are transferred to the sheet member P by the transfer device 36, are fixed to the sheet member P by heat and pressure that are applied from the fixing roller 64A and the pressure roller 64B.

Discharge Roller

A discharge roller 66, which discharges the sheet member P to which the toner images have been fixed to a discharge section 68 provided at an upper portion of the image forming apparatus 10, is provided on the downstream side of the fixing device 64 in the transport direction V of the sheet member P.

Recording Medium Reversing Path

After transferring and fixing the toner images to one side of the sheet member P, the image forming apparatus 10 can also transfer and fix the toner images to the other side of the sheet member P. In the image forming apparatus 10, the discharge roller 66 can transport the sheet member P in a direction opposite to the transport direction V. After being transported along a recording medium reversing path 70, the sheet member P, which is transported in the direction opposite to the transport direction V, is delivered to the recording medium transport belt 20 and is reversed.

Recording Medium Accommodating Unit

The recording medium accommodating unit 28, which accommodates a plurality of sheet members P, is provided on the upstream side of the transfer device 36 in the transport direction V of the sheet member P. Further, a take-out roller 30, which takes the uppermost sheet member P out from the recording medium accommodating unit 28, is provided so as to come into contact with the uppermost sheet member P that is accommodated in the recording medium accommodating unit 28. Furthermore, transport rollers 32 and 34, which transport the sheet member P taken out by the take-out roller 30 to the recording medium transport belt 20, is provided on the downstream side of the take-out roller 30 in the transport direction V of the sheet member P.

Developer

Developer is powder that mainly includes toner particles and an external additive. The toner particle and the external additive will be described below.

Toner Particle

It is preferable that a polymerized toner produced by a polymerization method be used as the toner of the developer to be used in the image forming apparatus 10.

When the shape of a toner is amorphous, the fluidity of the toner is not sufficient even though a fluid assistant is added to the toner. If fine particles, which are present on the toner surface, are moved to toner recesses by a mechanical shear force in use, the fluidity of the toner deteriorates with time. Further, if a fluid assistant is buried in the toner, the developability, transferability, and cleanability of the toner deteriorate. Furthermore, if a toner recovered by the cleaning is used in the developing device again, the deterioration of image quality is apt to further occur. If the amount of a fluid assistant to be added is further increased in order to prevent these, contamination, filming, damage, or the like occurs on the photoreceptor drum 12.

For this reason, methods of manufacturing a toner using an emulsion polymerization aggregation method have been proposed as means for intentionally controlling the shape and surface structure of a toner. In these methods, generally, fine resin particle-dispersion liquid where fine resin particles are dispersed is produced by a polymerization method such as emulsion polymerization; colorant particle-dispersion liquid where a colorant is dispersed in a solvent is produced; the fine resin particle-dispersion liquid and the colorant particle-dispersion liquid are aggregated by heating and/or pH control, the addition of a coagulant, and the like until the fine resin particles and the colorant have a desired particle size after the fine resin particle-dispersion liquid and the colorant particle-dispersion liquid are mixed with each other; and aggregated particles are stabilized so as to have a desired particle size and are then fused by being superheated to a temperature that is equal to or higher than the glass transition point of the fine resin particles. As a result, toner particles are produced.

In terms of particle size distribution characteristics, the toner particles obtained using the emulsion polymerization aggregation method are much more excellent than toner particles that are obtained using other polymerization methods typified by a suspension polymerization method in the related art or the like (particularly, the toner particles obtained using the emulsion polymerization aggregation method have sharp particle size distribution and do not need to be subjected to classification). If the toner particles obtained using the emulsion polymerization aggregation method are used as a toner, it is possible to obtain high image quality for a long time. Further, since aggregated particles are fused by being heated to a temperature, which is equal to or higher than the glass transition point (Tg) of the fine resin particles, in the method of manufacturing a toner using an emulsion polymerization aggregation method, it is possible to produce toners having various shapes, such as an amorphous shape and a spherical particle shape, by heating or pH control. Accordingly, it is possible to select a shape in the range from a so-called potato shape to a spherical shape in an electrophotographic method to be used.

External Additive

It is preferable that spherical silica is included in the external additive of the developer to be used in the image forming apparatus 10. The reason for this is that the refractive index of silica is about 1.5 and the deterioration of the transparency of silica caused by light scattering, particularly, a haze value (the index of optical transparency) when an image is formed on an OHP surface is not affected even though the particle size of silica is increased.

Meanwhile, generally, the specific gravity of fumed silica is 2.2 and the maximum particle size of fumed silica is 50 nm, which may be limitations on the manufacture. Further, the particle size of an aggregate can be increased, but it may be difficult for the particles to be uniformly dispersed. Accordingly, there may be a case where a sealing effect cannot be stably exhibited.

Silica that is suitable as a material of the external additive contained in order to improve cleanability, particularly, spherical monodisperse silica of which the specific gravity is in the range of 1.3 to 1.9 can be formed by a sol-gel method that is a wet method. Since the sol-gel method is a wet method and is a method of manufacturing silica without firing, the sol-gel method can control specific gravity so that specific gravity is low, as compared to other methods such as a vapor phase oxidation method. Further, it is possible to further adjust the specific gravity by controlling the kind of a hydrophobic treatment agent or the amount of the hydrophobic treatment agent in a hydrophobic treatment process. It is possible to freely control the particle size of silica by the hydrolysis of a sol-gel method, and the weight ratios, the reaction temperatures, the agitation rates, and the rates of supply of alkoxysilane, ammonia, alcohol, and water in a condensation polymerization process. It is also possible to form spherical monodisperse silica by a sol-gel method.

A specific method of manufacturing silica is as follows: first of all, a silane compound such as tetramethoxysilane is dropped into a mixed solution of water and alcohol and the mixed solution is agitated while ammonia water is used as a catalyst and heat is applied to the mixed solution. Next, generated silica sol suspension is separated into wet silica gel, alcohol, and ammonia water by centrifugation. A solvent is applied to the wet silica gel so as to change the wet silica gel into a silica sol again, and a hydrophobic treatment agent is applied to the silica sol so that the hydrophobization of the surface of the silica sol is performed. A general silane compound can be used in hydrophobic treatment. Next, a solvent is removed, dried, and sieved from the hydrophobic treatment silica sol, so that target silica can be obtained. Further, a treatment using the sol-gel method, which has been obtained in this way and described above again, may be performed.

Image Forming Process of Image Forming Apparatus

Next, an image forming process, which is performed by the image forming apparatus 10 according to the exemplary embodiment of the invention, will be described.

When the image forming apparatus 10 is operated, the surfaces of the respective photoreceptor drums 12 are charged by the respective charging rollers 14.

Next, the respective light beams, which are emitted from the latent image forming device 17 and correspond to the exposure signals, are emitted to the surfaces of the respective photoreceptor drums 12 that have been charged. Electrostatic latent images corresponding to the respective light beams are formed on the surfaces of the respective photoreceptor drums 12.

Next, the respective developing devices 26 develop the respective color toners on these electrostatic latent images, so that toner images corresponding to the respective color toners are formed on the surfaces of the respective photoreceptor drums 12.

After that, the respective toner images are transferred to the sheet member P, which is transported by the recording medium transport belt 20, from the photoreceptor drum 12Y corresponding to yellow, the photoreceptor drum 12M corresponding to magenta, the photoreceptor drum 12C corresponding to cyan, and the photoreceptor drum 12K corresponding to black in this order, and the respective toner images are superimposed. Accordingly, color (Y, M, and C) toner images and a black (K) toner image are formed on the sheet member P.

Next, the sheet member P is transported to the fixing device 64 and passes through a contact portion (nip portion) that is formed between the fixing roller 64A and the pressure roller 64B. At this time, the color toner images are fixed to the sheet member P by heat and pressure that are applied from the fixing roller 64A and the pressure roller 64B.

Finally, the sheet member P is discharged to the discharge section 68 provided at an upper portion of the image forming apparatus 10, and the formation of a color image on the sheet member P is finished. Meanwhile, when toner images are transferred and fixed to one surface of the sheet member P and toner images then are transferred and fixed to the other surface of the sheet member P, the sheet member P is reversed by the recording medium reversing path 70 and the transfer and fixing of the toner images are performed. After that, the sheet member P is discharged to the discharge section 68 and the formation of an image is finished.

Structure of Main Parts

Charging Device

Entirety

Figure 2:
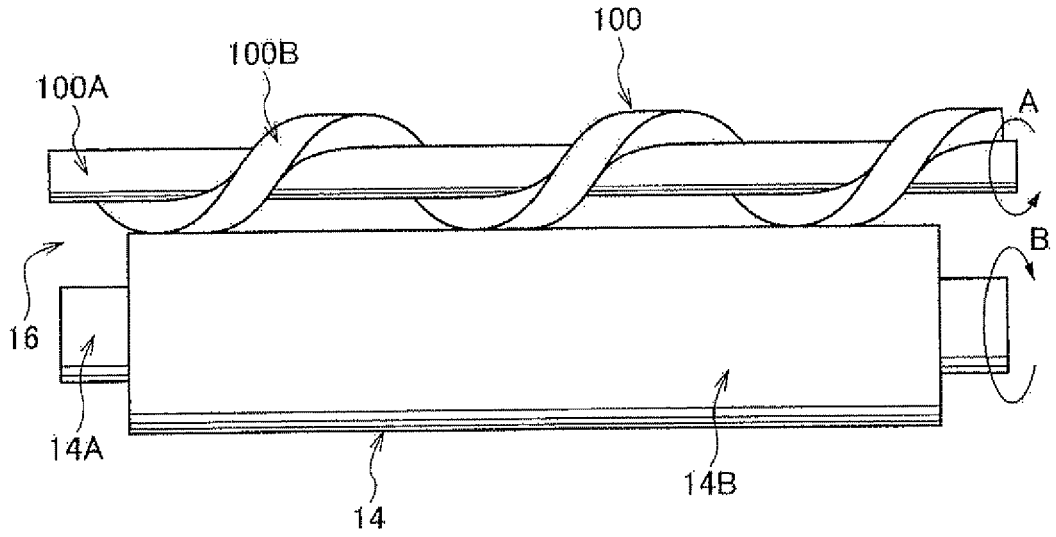
FIG. 2 is a view showing a charging device according to an exemplary embodiment of the invention.

FIG. 2 shows the charging device 16 as an example of a charging device according to an exemplary embodiment of the invention. As described above, the charging device 16 includes the charging roller 14 and the cleaning roller 100. Further, the charging roller 14 includes a rotating shaft 14A and a charging layer 14B. Furthermore, the cleaning roller 100 includes a rotating shaft 100A and a spiral portion 100B that is formed on the outer peripheral surface of the rotating shaft 100A.

Both end portions of the rotating shaft 14A of the charging roller 14 are pressed by compression springs (not shown), so that the outer peripheral surface of the charging roller 14 is pressed against the surface of the photoreceptor drum 12. Moreover, as the photoreceptor drum 12 rotates in the rotation direction in the image forming process, the charging roller 14 rotates in a direction (a direction of an arrow B) opposite to the rotation direction of the photoreceptor drum 12.

Meanwhile, the spiral portion 100E of the cleaning roller 100 and the outer peripheral surface of the charging roller 14 come into contact with each other while forming a nip. Further, as the charging roller 14 rotates in the direction of the arrow B, the cleaning roller 100 is driven to rotate in the direction (a direction of an arrow A) opposite to the direction of the arrow B.

Next, the cleaning roller 100 will be described with reference to FIGS. 3A, 3B and 4.

Figure 3A:
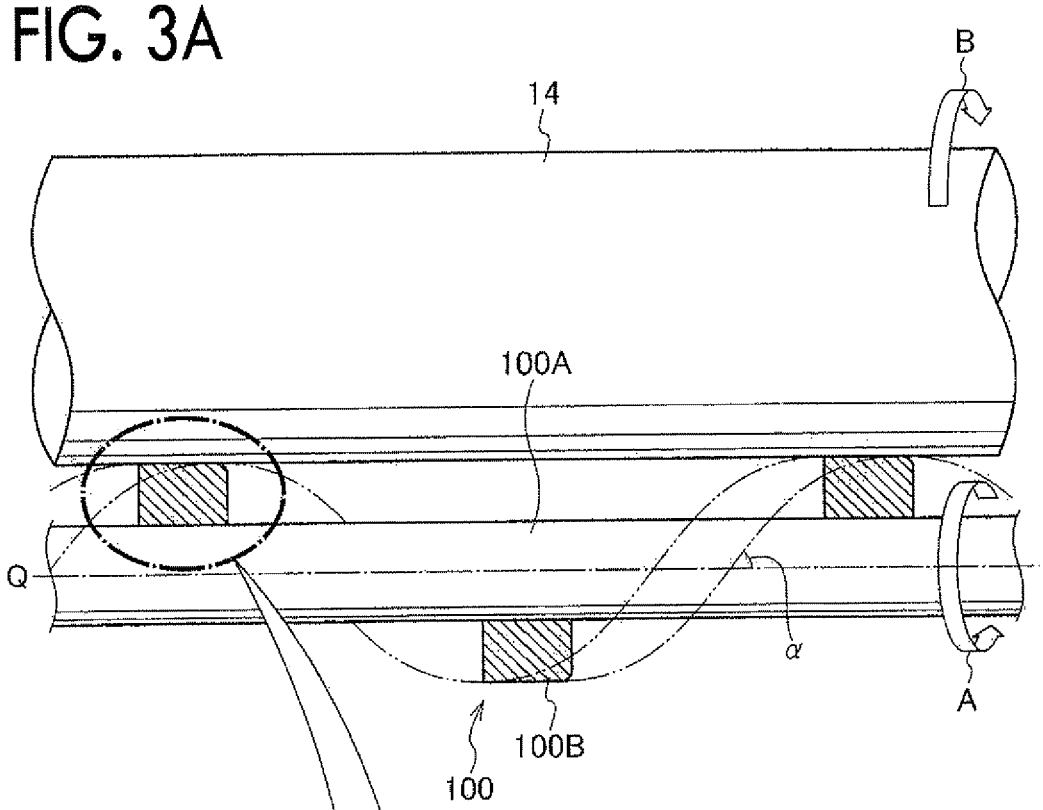
FIGS. 3A and 3B are cross-sectional views showing a state where a cleaning member according to an exemplary embodiment of the invention comes into contact with a body to be cleaned.
Figure 3B:
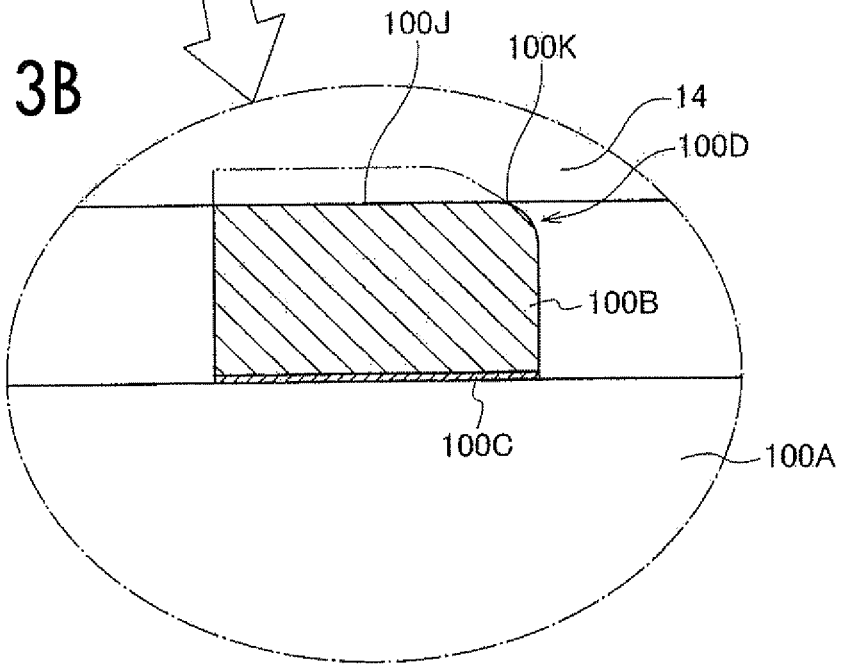

FIGS. 3A and 3B show the cross-sectional shape of the cleaning roller 100 when seen from the side. FIG. 3A is a cross-sectional view showing a state where the cleaning roller 100 comes into contact with the charging roller 14.

The spiral portion 100B, which is bonded to the outer peripheral surface of the rotating shaft 100A by an adhesive layer 100C, comes into contact with the charging roller 14. Here, the surface of the spiral portion 100B, which comes into contact with the outer peripheral surface of the charging roller 14 with rotation, is defined as a contact portion 100J. The shape of the contact portion 100J will be described in detail below.

Figure 4:
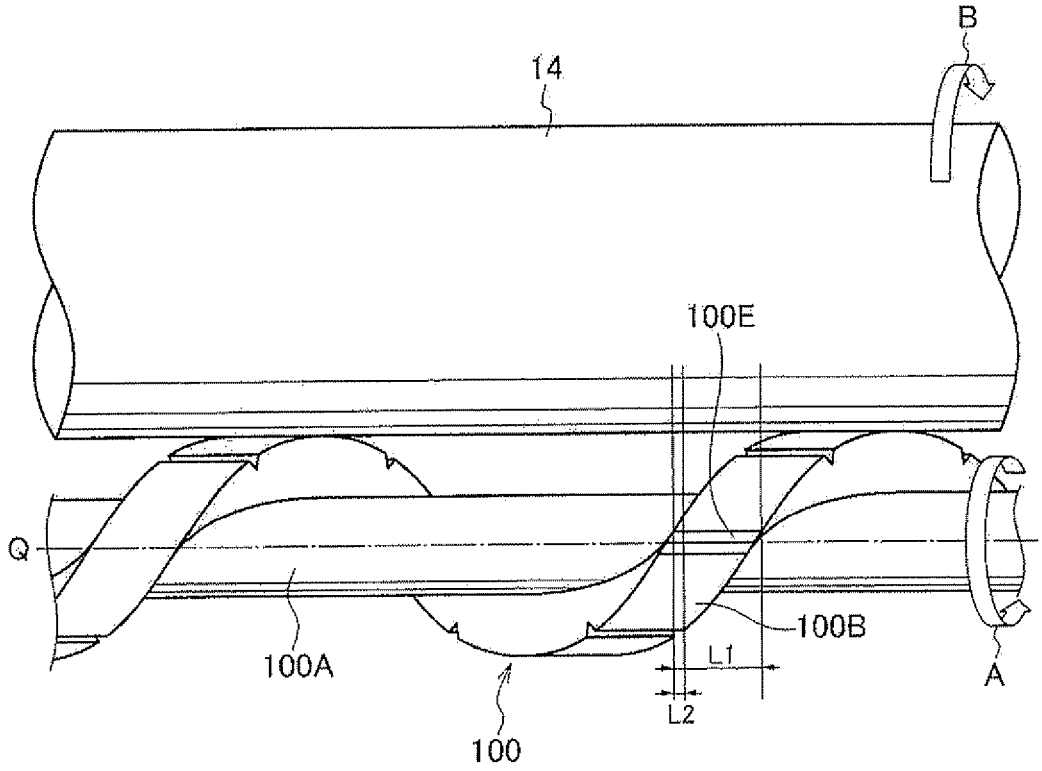
FIG. 4 is a side view showing a state where the cleaning member according to the exemplary embodiment of the invention comes into contact with a charging member.

FIG. 4 is a side view showing a state where the cleaning roller 100 comes into contact with the charging roller 14.

A plurality of cut portions 100E, each of which is an example of a step facing the direction of the arrow B, are formed on the contact portion 100J of the spiral portion 100B that comes into contact with the outer peripheral surface of the charging roller 14. The cut portions are portions that have side surfaces formed by cuts. Steps are formed by the outer peripheral surface of the cleaning roller 100 and the side surfaces.

Since the cleaning roller 100 and the outer peripheral surface of the charging roller 14 come into contact with each other while forming a nip as described above, the cleaning roller 100 is driven to rotate in the direction of the arrow A opposite to the direction of the arrow B as the charging roller 14 rotates in the direction of the arrow B. In this case, the rotational speed of the outer peripheral surface of the cleaning roller 100 is the same as the rotational speed of the outer peripheral surface of the charging roller 14.

The cut portions 100E formed on the contact portion 100J come into contact with the charging roller 14 as the cleaning roller 100 rotates. While being crushed by the charging roller 14, the cut portions 100E coming into contact with the charging roller 14 move along the outer peripheral surface of the charging roller 14. Further, when being separated from the outer peripheral surface of the charging roller 14, the cut portions 100E are repelled from the charging roller 14. The plurality of cut portions 100E are repeatedly repelled from the charging roller 14 as described above, so that foreign materials, such as toner, external additives, and paper powder, adhering to the outer peripheral surface of the charging roller 14 are removed (moved).

The rotating shaft 14A of the charging roller 14 and the rotating shaft 100A of the cleaning roller 100 are formed in a fixed-position manner where a distance between axes corresponds to fixed positions. However, the positioning of the cleaning roller 100 relative to the charging roller 14 may be performed in a constant-load manner.

Charging Member

Next, the charging roller 14 will be described in detail.

The charging roller 14 includes a conductive elastic layer (not shown) and a surface layer as a charging layer 14B on the rotating shaft 14A. Meanwhile, the surface layer is formed on the outer peripheral surface of the conductive elastic layer.

Diameter of Charging Roller 14

The diameter of the charging roller 14 is in the range of ϕ 8 mm to ϕ 15 mm, more preferably, in the range of ϕ 9 mm to ϕ 14 mm. Further, it is preferable that the thickness of the charging layer be in the range of 1.5 mm to 4 mm.

Material of Rotating Shaft

Free-cutting steel, stainless steel, and the like may be used as a material of the rotating shaft 14A. A material and a surface treatment method are selected according to an intended purpose such as slidability. A non-conductive material is used after being processed by a general treatment such as a plating treatment and subjected to a conduction treatment.

Material of Conductive Elastic Layer of Charging Layer

The conductive elastic layer of the charging layer 14B of the charging roller 14 is made of an elastic material such as rubber having elasticity and a conductive material, such as carbon black or an ion-conductive material, adjusting the resistance of the conductive elastic layer, and a filler, such as a softener, a plasticizer, a hardener, a vulcanizing agent, a vulcanizing accelerator, an antioxidant, silica, or calcium carbonate, as necessary. Materials generally added to rubber may be added in addition to these.

The charging roller 14 is formed by coating the outer peripheral surface of the rotating shaft 14A with a mixture to which materials generally added to rubber are added. A material in which a material, which conducts electricity using electrons and/or ions as carriers, such as carbon black or an ion conducting agent, blended in a matrix material is dispersed, and the like may be used as a conducting agent that is to adjust a resistance value. Further, the elastic material may be a foam body.

The elastic material, which forms the above-mentioned conductive elastic layer, is formed by dispersing a conducting agent in, for example, a rubber material. Examples of the rubber material include isoprene rubber, chloroprene rubber, epichlorohydrin rubber, butyl rubber, urethane rubber, silicone rubber, fluorine-containing rubber, styrene-butadiene rubber, butadiene rubber, nitrile rubber, ethylene-propylene rubber, epichlorohydrin-ethylene oxide copolymer rubber, epichlorohydrin-ethylene oxide-allylglycidyl ether copolymer rubber, ethylene-propylene-diene terpolymer rubber (EPDM), acrylonitrile-butadiene copolymer rubber, natural rubber, and mixtures thereof. Among them, silicone rubber, ethylene-propylene rubber, epichlorohydrin-ethylene oxide copolymer rubber, epichlorohydrin-ethylene oxide-allylglycidyl ether copolymer rubber, acrylonitrile-butadiene copolymer rubber, and mixtures thereof are preferably used. These rubber materials may be foamed materials or non-foamed materials.

An electron conducting agent or an ion conducting agent is used as the conducting agent. For example, fine powder of pyrolytic carbon or carbon black, such as Ketjen black or acetylene black; various conductive metals or alloys, such as graphite, aluminum, copper, nickel, and stainless steel; various kinds of conductive metal oxide, such as tin oxide, indium oxide, titanium oxide, tin oxide-antimony oxide solid solution, and tin oxide-indium oxide solid solution; and an insulating material of which the surface is subjected to a conduction treatment is used as the electron conducting agent. Further, for example, chlorate or perchlorate, such as tetraethylammonium and lauryltrimethylammonium, alkali metal, such as lithium and magnesium, chlorate and perchlorate of alkali earth metal, and the like are used as the ion conducting agent.

The above-mentioned conducting agents may be used alone, and the combination of two or more of the conducting agents may be used. Furthermore, the amount of the conducting agent to be added is not particularly limited, but it is preferable that the amount of the above-mentioned electron conducting agent to be added be in the range of 1 to 60 parts by weight based on 100 parts by weight of a rubber material. Meanwhile, it is preferable that the amount of the above-mentioned ion conducting agent to be added be in the range of 0.1 to 5.0 parts by weight based on 100 parts by weight of a rubber material.

Material of Surface Layer of Charging Layer

The surface layer, which is formed on the outer peripheral surface of the above-mentioned conductive elastic layer, is to prevent contamination that is caused by foreign materials such as toner. Any one of a resin, rubber, and the like may be used as a material of the surface layer, and the material of the surface layer is not particularly limited. Examples of the material of the surface layer include polyester, polyimide, copolymer nylon, a silicone resin, an acrylic resin, polyvinyl butyral, an ethylene tetrafluoroethylene copolymer, a melamine resin, fluorine-containing rubber, an epoxy resin, polycarbonate, polyvinyl alcohol, cellulose, polyvinylidene chloride, polyvinyl chloride, polyethylene, and a ethylene-vinyl acetate copolymer.

In terms of contamination that is caused by external additives, it is preferable that polyvinylidene fluoride, a tetrafluoroethylene copolymer, polyester, polyimide, or copolymer nylon among them be used as the material of the surface layer. Copolymer nylon includes one or more of 610 nylon, 11 nylon, and 12 nylon as a polymerization unit, and other polymerization units included in this copolymer may be 6 nylon, 66 nylon, and the like. Here, it is preferable that a ratio of a polymerization unit, which is formed of 610 nylon, 11 nylon, and 12 nylon and is included in the copolymer, be 10% or more by weight ratio. If the ratio of the polymerization unit is 10% or more, a liquid-preparation property and a film forming property at the time of the application of the surface layer are excellent, particularly, the wear of a resin layer at the time of repeated use or the adhesion of foreign materials to the resin layer is reduced, the durability of a roller is excellent, and the change of the properties caused by environment is also reduced.

The above-mentioned polymeric material may be used alone, and the combination of two or more of the polymeric materials may be used. Further, the number-average molecular weight of the above-mentioned polymeric materials is preferably in the range of 1000 to 100000 and more preferably in the range of 10000 to 50000.

Furthermore, it is possible to adjust a resistance value by containing a conductive material in the above-mentioned surface layer. It is preferable that a conductive material having a particle size of 3 μm or less be used as the conductive material.

Moreover, a material in which a material, which conducts electricity using electrons and/or ions as charge carriers, such as carbon black, conductive metal oxide particles, or an ion conducting agent, blended in a matrix material is dispersed, and the like may be used as a conducting agent that is to adjust a resistance value.

Specifically, examples of the carbon black of the conducting agent include "special black 350", "special black 100", "special black 250", "special black 5", "special black 4", "special black 4A", "special black 550", "special black 6", "color black FW200", "color black FW2", and "color black FW2V" that are manufactured by Degussa Co., Ltd. Further, examples of the carbon black of the conducting agent include "MONARCH1000", "MONARCH1300", "MONARCH1400", "MOGUL-L", and "REGAL400R" that are manufactured by Cabot Corporation.

The above-mentioned carbon black has a pH of 4.0 or less, and has high dispersibility into a resin composition due to the effect of an oxygen-containing functional group that is present on the surface of this carbon black, as compared to general carbon black. Further, it is possible to improve the charging uniformity and to reduce the change of a resistance value by the blend of the carbon black having a pH of 4.0 or less.

The conductive metal oxide particles, which are conductive particles used to adjust the resistance value, are conductive particles, such as tin oxide, antimony-doped tin oxide, zinc oxide, anatase-type titanium oxide, and ITO. Any conducting agent, which uses electrons as charge carriers, may be used. These may be used alone, and two or more of them may be used together. Meanwhile, in terms of the adjustment of a resistance value and strength, tin oxide, antimony-doped tin oxide, and anatase-type titanium oxide are preferably used and tin oxide and antimony-doped tin oxide are more preferably used. Resistance is controlled by these conductive materials, so that the resistance value of the surface layer is not changed by environmental conditions and stable properties are obtained.

Moreover, it is preferable that a fluorine-based resin or a silicone-based resin be used for the above-mentioned surface layer and the surface layer be formed of a fluorine-modified acrylate polymer. Further, fine particles may be added to the surface layer. Accordingly, the surface layer becomes hydrophobic, so that the adhesion of foreign materials to the charging roller 14 is prevented. Furthermore, insulating particles, such as alumina or silica, may be added to make the surface of the charging roller 14 uneven and a load generated when the photoreceptor drum 12 is rubbed against the charging roller 14 may be reduced, so that wear resistance of the charging roller 14 and the photoreceptor drum 12 is improved.

Cleaning Member

Next, the cleaning roller 100 as an example of a cleaning member will be described in detail.

Material of Rotating Shaft

Metal, such as aluminum, stainless steel, or brass, is mainly used for the rotating shaft 100A of the cleaning roller 100, and a material or a surface treatment method is selected according to an intended purpose such as slidability. A non-conductive material may be processed by a general treatment such as a plating treatment and may be subjected to a conduction treatment. Further, since grinding in the related art does not need to be performed and the stiffness of the shaft required for machining is also low when the rotating shaft 100A is manufactured, a resin shaft may be used.

Material of Spiral Portion

A material of the spiral portion 100B is formed of a foam body that has a porous three-dimensional structure, and the spiral portion 100B is wound on the rotating shaft 100A after being machined to have necessary thickness and width. This foam body is selected from foamable resins, such as polyurethane, polyethylene, polyamide, and polypropylene, and substances that use NBR, EPDM, SBR, silicone rubber, and the like as materials. The spiral portion 100B has a function of efficiently removing foreign materials, such as toner, external additives, and paper powder by rotating while pressing the charging roller 14.

Meanwhile, it is particularly preferable that the spiral portion 100B be made of polyurethane strong against tearing, a pull, and the like to prevent the surface of the charging roller 14 from being damaged by the rub of the spiral portion 100B and to prevent the surface of the charging roller 14 from being torn or broken over a long period of time.

Meanwhile, the material of the spiral portion is not particularly limited to polyurethane. The material of the spiral portion is polyol, such as polyester polyol, polyether polyester, or acrylic polyol or 2,4-tolylene diisocyanate, 2,6-tolylene diisocyanate, 4,4-diphenylmethane diisocyanate, tolidine diisocyanate, 1,6-hexamethylene diisocyanate, or the like accompanied by the reaction of isocyanate, and it is preferable that a chain extender such as 1,4-butanediol or trimethylolpropane, be mixed with the material of the spiral portion. Further, the material of the spiral portion is generally foamed using a foaming agent such as water or an azo compound like azodicarbonamide or azobisisobutyronitrile. Furthermore, assistants, such as a foaming assistant, a foam stabilizer, and a catalyst, may be added as necessary.

Cross-Sectional Shape: FIGS. 3A and 3B

Next, the cross-sectional shape of the cleaning roller 100, which is seen from the side, will be described in detail with reference to FIG. 3B.

One end portion of both end portions of the contact portion 100J of the spiral portion 100B in a width direction is formed so as to be gradually separated from the contact portion 100J, which comes into contact with the charging roller 14, toward the one end portion from the contact portion 100J. In other words, the height of the spiral portion 100B from the outer peripheral surface of the rotating shaft 100A is gradually reduced from the height of the contact portion 100J, which comes into contact with the charging roller 14, toward the one end portion from the contact portion 100J that comes into contact with the charging roller 14. The boundary of one end portion of the contact portion 100J, which gradually descends from the height of the contact portion 100J coming into contact with the charging roller 14 as described above, is defined as a boundary portion 100K. Meanwhile, a corner is formed at the other end portion of the spiral portion. A rounded corner 100D is formed at the same end portion as the boundary portion 100K and is part of the spiral portion that does not contact the charging roller 14.

A two-dot chain line of FIG. 3B shows the shape of the spiral portion 100E when the cleaning roller 100 does not come into contact with the charging roller 14. When the spiral portion 100B does not come into contact with the charging roller 14, the spiral portion 100B has a shape that includes the portion shown by the two-dot chain line. Meanwhile, when coming into contact with the charging roller 14, the outer peripheral surface of the spiral portion 100B is pressed against the charging roller 14 and the spiral portion 100B is elastically deformed into a cross-sectional shape of a hatched portion that is surrounded by a solid line.

Meanwhile, the spiral portion 100B is formed so that an angle between the axial direction of the rotating shaft 100A (the direction of a straight one-dot chain line Q) and the spiral portion 100B becomes $\alpha$.

As described above, the charging device 16 is adapted so that the rotating shaft 100A of the cleaning roller 100 rotates in the direction of the arrow A when the charging roller 14 rotates in the direction of the arrow B. When the rotating shaft 100A rotates in the direction of the arrow A, the spiral portion 100B provided on the outer peripheral surface of the rotating shaft 100A comes into contact with the charging roller 14 by a predetermined distance in the axial direction of the rotating shaft 100A as shown in FIG. 3A.

In this case, both end portions of the spiral portion 100B, which comes into contact with the charging roller 14, are divided into a portion that comes into contact with the charging roller 14 first and a portion that comes into contact with the charging roller 14 later. Further, in the cleaning roller 100, the "portion that comes into contact with the charging roller 14 first" is the above-mentioned "portion that gradually descends from the height of the contact portion 100J coming into contact with the charging roller 14" and is a portion of the boundary portion 100K.

Step: FIG. 4

Next, the cut portions 100E, which are formed on the contact portion 100J of the cleaning roller 100, will be described with reference to FIG. 4. FIG. 4 is a side view showing a state where the cleaning roller 100 comes into contact with the charging roller 14. The plurality of cut portions 100E are formed parallel to the axial direction of the rotating shaft 100A of the cleaning roller 100, and are formed at a predetermined interval in the rotation direction of the rotating shaft 100A. Further, the cut portions 100E are formed on the entire upper surface of the spiral portion 100B in the width direction. Furthermore, one side of the cut portion 100E, which is positioned on the upstream side in the rotation direction of the cleaning roller 100, faces the rotation direction of the rotating shaft 100A of the cleaning roller 100 at the contact portion that comes into contact with the charging roller 14, and shows an example of a step.

Here, the width direction of the spiral portion 100B is defined as the axial direction of the rotating shaft 100A. In this case, the width of the cut portion 100E is denoted by L1. Further, one cut portion 100E and another adjacent cut portion 100E are formed so as to overlap each other by a length L2 in the axial direction of the rotating shaft 100A.

Furthermore, when the spiral portion 1003 is formed by winding a foam body on the rotating shaft 100A, the cut portions 100E are formed so as to be further opened toward the upper surface of the spiral portion 100B from the surface of the rotating shaft 100A. Cleaning rollers 100, which are manufactured by manufacturing methods of FIGS. 8A to 11E to be described below, become like this.

Meanwhile, a cleaning roller is also manufactured by covering the entire outer peripheral surface of the rotating shaft with a cylindrical foam body, forming a spiral portion by machining the form so that the shape of the foam body becomes a spiral shape, and forming cut portions by cutting the spiral portion. In the case of a cleaning roller that is manufactured by this manufacturing method, the cut portions are formed so as to be closed and opened by a friction force applied from the charging roller when the cleaning roller comes into contact with the charging roller. As a result, openings are formed. That is, even though steps are closed cut portions, openings only have to be formed when the cleaning roller comes into contact with the charging roller.

Operation of Exemplary Embodiment of Invention

Next, the operations of the cleaning member, the charging device, the assembly, and the image forming apparatus according to the exemplary embodiments of the invention will be described.

After the respective color toner images are formed on the surfaces of the respective photoreceptor drums 12 of the respective process cartridges 18, the respective toner images are transferred to the sheet member P transported by the recording medium transport belt 20 and are superimposed.

Meanwhile, after the respective toner images are transferred to the sheet member P, each photoreceptor drum 12 is rotated while foreign materials, such as toner not transferred to the sheet member P, external additives, and paper powder, adhere to the surface of each photoreceptor drum 12.

The foreign materials are removed from the surface of each photoreceptor drum 12 by each removal device 80. However, foreign materials, which are not removed by each removal device 80, further adhere to the surface of each photoreceptor drum 12 and come into contact with the surface of each charging roller 14.

A part of the foreign materials, which come into contact with the surface of each charging roller 14, are transferred to the surface of each charging roller 14, adhere to the surface of each charging roller 14, and are moved with the rotation of each charging roller 14.

After that, the foreign materials, which are moved with the rotation of each charging roller 14, come into contact with the cut portions 100E of the cleaning roller 100 that comes into contact with the charging roller 14 while rotating. The deformed spiral portion 100B is restored, so that the foreign materials are removed from the charging roller 14.

The foreign materials, which are removed from the charging roller 14, are moved in the advancing direction of the spiral portion 100B with the rotation of the rotating shaft 100A.

Further, the height of the portion of the spiral portion 100B, which comes into contact with the charging roller 14 first, (the portion of the boundary portion 100K) from the outer peripheral surface of the rotating shaft 100A is gradually reduced from the height of the contact portion 100J, which comes into contact with the charging roller 14, toward the portion, which comes into contact with the charging roller 14 first, from the contact portion 100J that comes into contact with the charging roller 14. For this reason, the tearing of the spiral portion from the end portion of the contact portion 100J, which comes into contact with the charging roller 14, in the width direction of the spiral portion 100B is suppressed.

Further, one side of the cut portion 100E, which is positioned on the upstream side in the rotation direction of the cleaning roller 100, faces the rotation direction of the rotating shaft 100A of the cleaning roller 100 at the contact portion that comes into contact with the charging roller 14. Accordingly, it is easy to remove foreign materials as compared to a case where one side of the cut portion does not face the contact portion.

Furthermore, the cut portions 100E are formed so as to be further opened toward the contact portion 100J of the spiral portion 1003 from the outer peripheral surface of the rotating shaft 100A not only when the cut portions 100E come into contact with the charging roller 14 but also when the cut portions 100E do not come into contact with the charging roller 14. Accordingly, when the cleaning roller 100 is separated from the charging roller 14, it is difficult for the deformation and restoration of the surface portion of the cut portion 1005 of the cleaning roller 100 to be limited. Therefore, the surface portion of the cut portion 1005 can freely vibrate, so that the foreign materials are flicked.

Moreover, the plurality of cut portions 1005 formed on the spiral portion 1003 are formed so as to overlap each other in the axial direction of the rotating shaft 100A of the cleaning roller 100. According to this structure, the foreign materials adhering to the surface of the charging roller 14 are apt to come into contact with the plurality of cut portions 1005.

Further, the deterioration of the charging performance, which is caused by poor cleaning, of the charging device 16 including the cleaning roller 100 is suppressed as compared to that of a charging device that includes a cleaning member including a spiral portion and does not include cut portions 1005 including portions facing the rotation direction of the cleaning roller 100 and formed on the contact portion 100J and one end portion gradually separated from the contact portion 100J toward the one end portion of both end portions of the contact portion 100J in the width direction.

Furthermore, the deterioration of the charging performance, which is caused by poor cleaning, of the process cartridge 18 including the charging device 16 including the cleaning roller 100 is suppressed as compared to a case where cut portions 100E including portions facing the rotation direction of the cleaning roller 100 and formed on the contact portion 100J and one end portion gradually separated from the contact portion 100J toward the one end portion of both end portions of the contact portion 100J in the width direction are not provided.

Moreover, according to the image forming apparatus 10 including the charging device 16 including the cleaning roller 100, the deterioration of image quality caused by poor charging is suppressed as compared to a case where this structure is not provided.

Modification of Exemplary Embodiment of Invention

Modification of end portion of contact portion of spiral portion

Figure 5A:
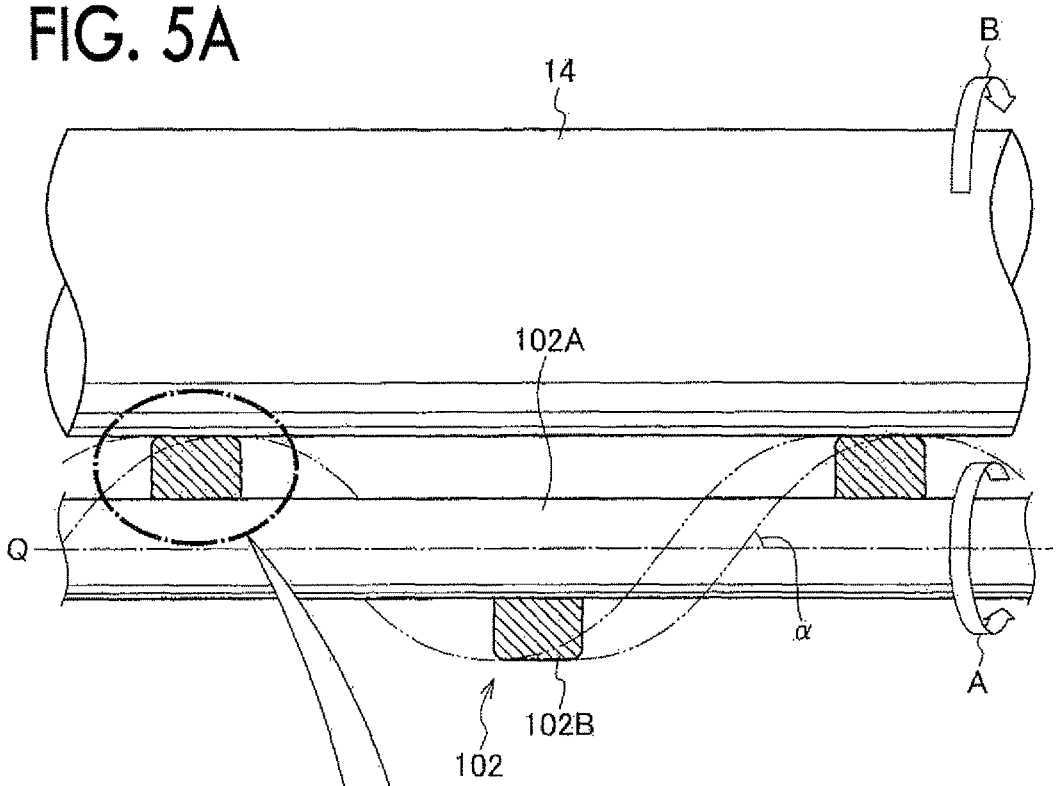
FIGS. 5A and 5B are cross-sectional views showing a state where another cleaning member according to an exemplary embodiment of the invention comes into contact with the charging member.
Figure 5B:
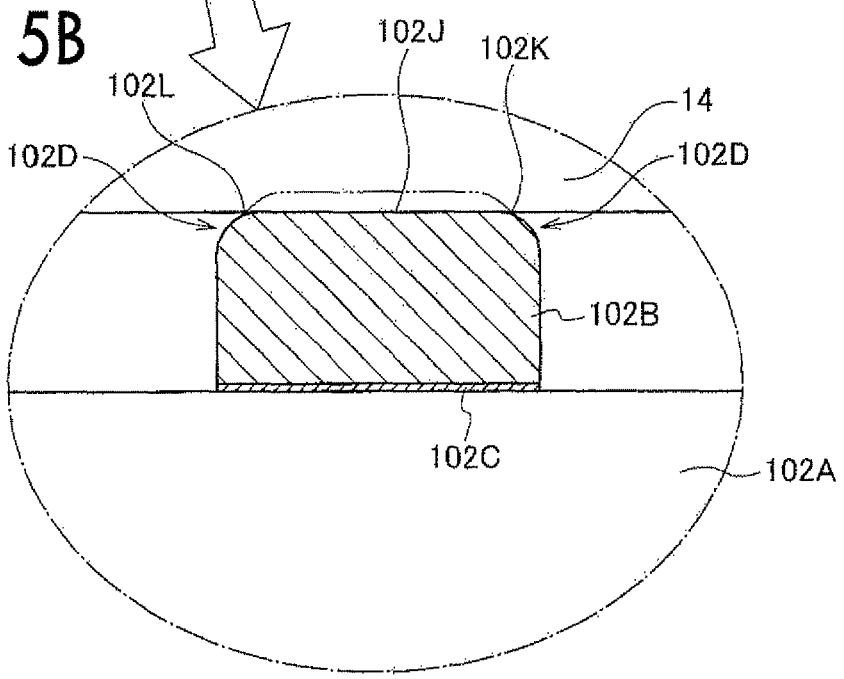

First Modification: FIGS. 5A and 5B

Next, a first modification of the exemplary embodiment of the invention will be described mainly using the differences between the first modification and the cleaning member 100, the charging device, the assembly, and the image forming apparatus according to the exemplary embodiments of the invention.

FIG. 5A is a cross-sectional view showing a state where a cleaning roller 102 as a first modification of the cleaning member according to the exemplary embodiment of the invention comes into contact with a charging roller 14 as an example of a body to be cleaned. Further, FIG. 5B is an enlarged cross-sectional view of a part of FIG. 5A.

The shape of a spiral portion 102B will be described with reference to FIG. 5B. Both end portions of a contact portion 102J of the spiral portion 102B in a width direction are formed so as to be gradually separated from the contact portion 102J, which comes into contact with the charging roller 14, toward the both end portions from the contact portion 102J at end portions 102K and 102L as boundaries. In other words, the height of the spiral portion 102B from the outer peripheral surface of a rotating shaft 102A is gradually reduced from the height of the contact portion 102J, which comes into contact with the charging roller 14, toward both end portions from the contact portion 102J, which comes into contact with the charging roller 14, at the end portions 102K and 102L as boundaries. Rounded corners 102D are formed at the end portions 102K and 102L.

Further, a two-dot chain line of FIG. 53 shows the shape of the spiral portion 1023 when the cleaning roller 102 does not come into contact with the charging roller 14.

Since any one of a portion that comes into contact with the charging roller 14 first and a portion that comes into contact with the charging roller 14 later may come into contact with the charging roller 14 first, the orientation of the cleaning roller 102 to be mounted on the charging roller 14 is not limited.

Accordingly, the charging device including the cleaning roller 102 is easily produced. Other operations are the same as the operations of the exemplary embodiment of the invention.

Figure 6A:
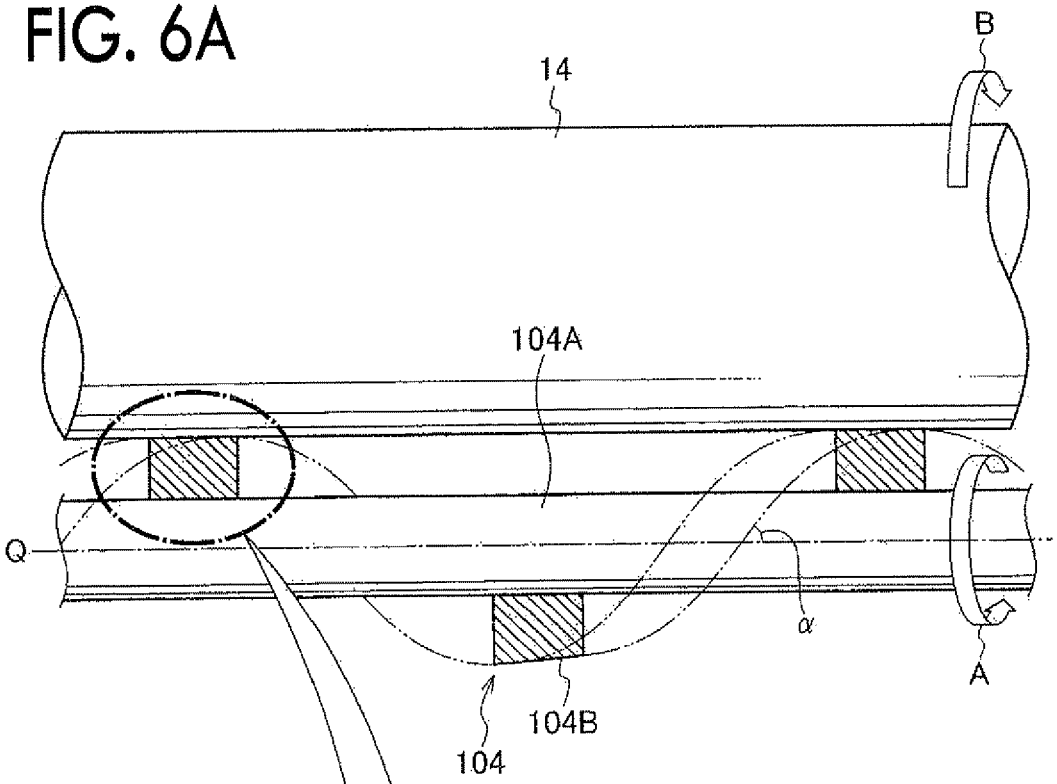
FIGS. 6A and 6B are cross-sectional views showing a state where another cleaning member according to an exemplary embodiment of the invention comes into contact with the charging member.
Figure 6B:
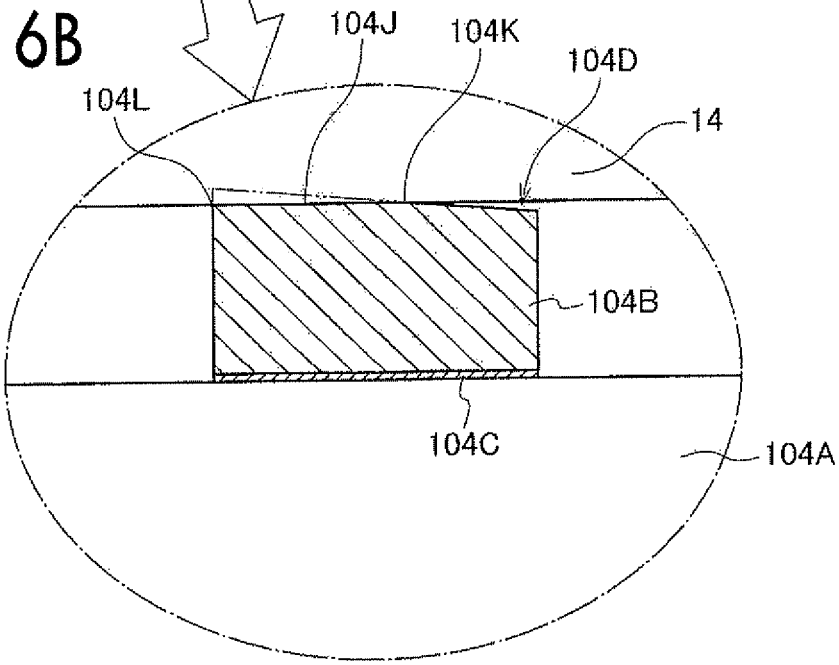

Second Modification: FIGS. 6A and 6B

Next, a second modification of the exemplary embodiment of the invention will be described mainly using the differences between the second modification and the cleaning members, the charging devices, the assemblies, and the image forming apparatuses according to the first modification and the exemplary embodiments of the invention.

FIG. 6A is a cross-sectional view showing a state where a cleaning roller 104 as a second modification of the cleaning member according to the exemplary embodiment of the invention comes into contact with a charging roller 14. Further, FIG. 6B is an enlarged cross-sectional view of a part of FIG. 6A.

The shape of a spiral portion 104E will be described with reference to FIG. 6B. When the cleaning roller 104 is seen from the side, the outer peripheral surface of the spiral portion 104B is formed in the shape of a straight line so as to have an angle with respect to the axial direction of a rotating shaft 104A (the direction of a straight one-dot chain line Q). The cleaning roller 104 including the spiral portion 104B is formed so that one end portion of the outer peripheral surface of the spiral portion 104B in a width direction comes into contact with the charging roller 14 and the other end portion thereof is separated from the charging roller 14. In this case, the other end portion thereof is formed so as to be gradually separated from a contact portion 104J, which comes into contact with the charging roller 14, at a boundary portion 104K as a boundary.

Further, a two-dot chain line of FIG. 6B shows the shape of the spiral portion 104B when the cleaning roller 104 does not come into contact with the charging roller 14.

This operation is the same as the operation of the exemplary embodiment of the invention.

Figure 7A:
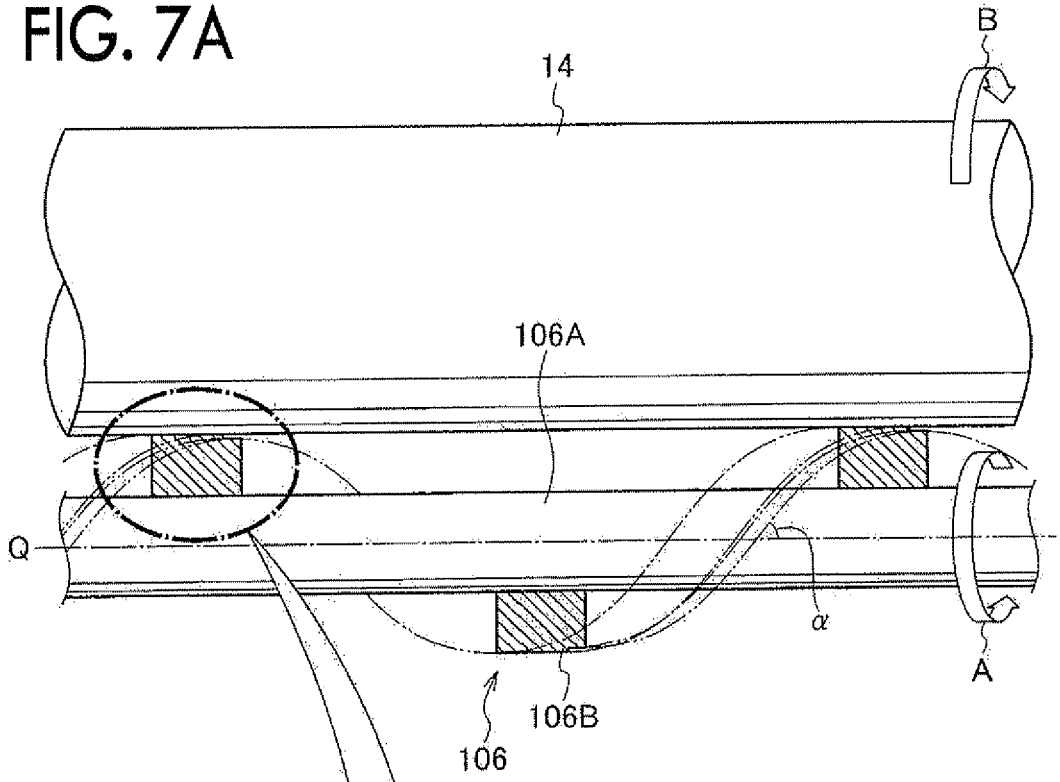
FIGS. 7A and 7B are cross-sectional views showing a state where another cleaning member according to an exemplary embodiment of the invention comes into contact with the charging member.
Figure 7B:
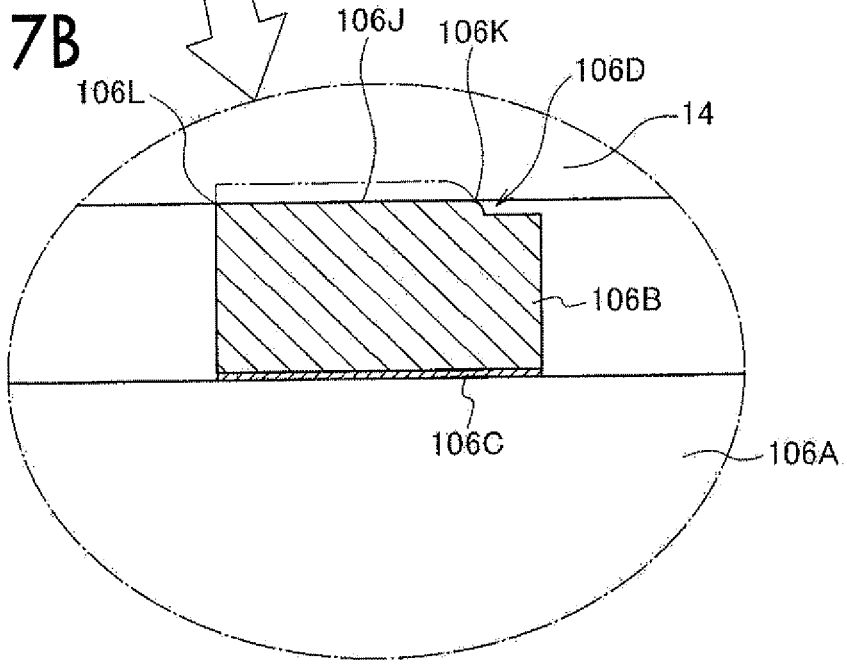

Third Modification: FIGS. 7A and 7B

Next, a third modification of the exemplary embodiment of the invention will be described mainly using the differences between the third modification and the cleaning members, the charging devices, the assemblies, and the image forming apparatuses according to the first and second modifications and the exemplary embodiments of the invention.

FIG. 7A is a cross-sectional view showing a state where a cleaning roller 106 as a third modification of the cleaning member according to the exemplary embodiment of the invention comes into contact with a charging roller 14. Further, FIG. 7B is an enlarged cross-sectional view of a part of FIG. 7A.

The shape of a spiral portion 106B will be described with reference to FIG. 7B. The upper surface of the spiral portion 106B is gradually separated from a contact portion, which comes into contact with the charging roller 14, from one end portion of both end portions toward the other end portion thereof, and faces the charging roller 14. In other words, the height of the spiral portion 106B from the outer peripheral surface of a rotating shaft 106A is gradually reduced from the height of a contact portion 106J, which comes into contact with the charging roller 14, toward the other end rather than the other end portion from the contact portion 106J, which comes into contact with the charging roller 14. As a result, the spiral portion 106B is separated from the charging roller 14 and faces the charging roller 14. End portions 106K and 106L form boundaries for the contact portion 106J. A rounded corner 106D is formed at the end portion 106K.

Further, a two-dot chain line of FIG. 7B shows the shape of the spiral portion 106B when the cleaning roller 106 does not come into contact with the charging roller 14.

Accordingly, since the other end portion of the outer peripheral surface of the spiral portion 106B of the cleaning roller 106 only has to be separated from the charging roller 14, the shape of the other end portion of the outer peripheral surface of the spiral portion 106B is not limited. Other operations are the same as the operations of the exemplary embodiment of the invention.

Modification of Step of Contact Portion of Spiral Portion

Figure 8A:
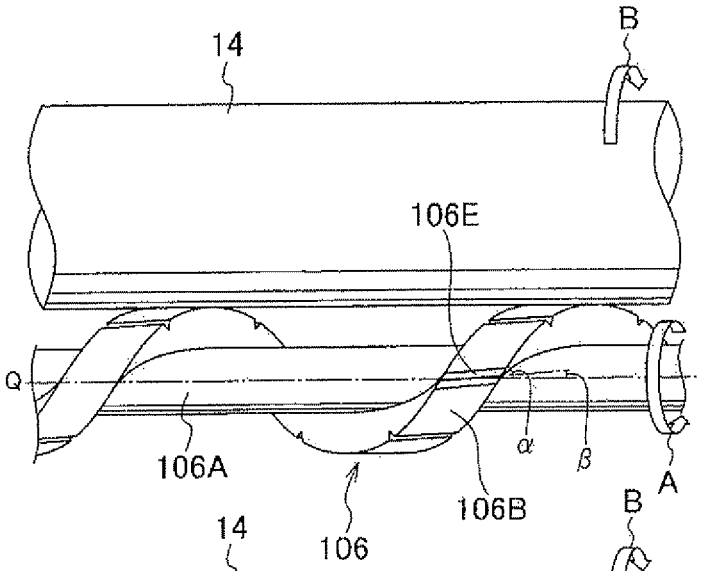
FIGS. 8A, 8B, and 8C are cross-sectional views showing states where other cleaning members according to exemplary embodiments of the invention come into contact with the charging member.

Fourth Modification: FIG. 8A

Next, a fourth modification of the exemplary embodiment of the invention will be described mainly using the differences between the fourth modification and the cleaning members, the charging devices, the assemblies, and the image forming apparatuses according to the first to third modifications and the exemplary embodiments of the invention.

FIG. 8A is a cross-sectional view showing a state where a cleaning roller 106 as a fourth modification of the cleaning member according to the exemplary embodiment of the invention comes into contact with a charging roller 14. Further, the shape of a spiral portion 106B of the cleaning roller 106 is shown in FIG. 3 that has been described above.

Cut portions 106E are formed on the outer peripheral surface of the cleaning roller 106. A plurality of cut portions 106E are formed so as to have an angle 13 with respect to the axial direction of a rotating shaft 106A of the cleaning roller 106 (the direction of a straight one-dot chain line Q), and are formed at a predetermined interval in the rotation direction of the rotating shaft 106A (the direction of an arrow A). Further, one side of the cut portion 106E, which is positioned on the upstream side in the rotation direction of the cleaning roller 106, faces the rotation direction of the rotating shaft 106A of the cleaning roller 106 at the contact portion that comes into contact with the charging roller 14, and shows an example of a step.

Meanwhile, it is preferable that the angle $\beta$ be smaller than an angle $\alpha$ between the spiral portion 106B and the rotating shaft 106A. According to this, cleanability on the charging roller 14 is improved. Other operations are the same as the operations of the exemplary embodiment of the invention.

Figure 8B:
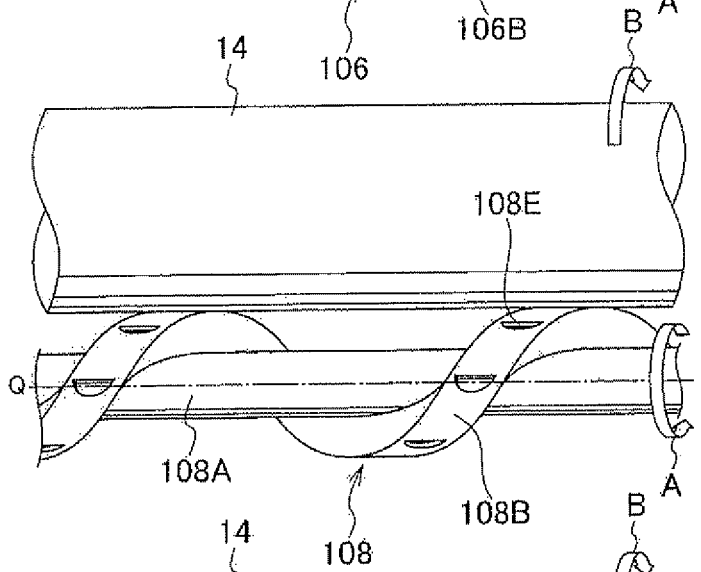

Fifth Modification: FIG. 8B

Next, a fifth modification of the exemplary embodiment of the invention will be described mainly using the differences between the fifth modification and the cleaning members, the charging devices, the assemblies, and the image forming apparatuses according to the first to fourth modifications and the exemplary embodiments of the invention.

FIG. 8B is a cross-sectional view showing a state where a cleaning roller 108 as a fifth modification of the cleaning member according to the exemplary embodiment of the invention comes into contact with a charging roller 14.

Steps 108E are formed on the outer peripheral surface of the cleaning roller 108. The plurality of steps 1085 are formed parallel to the axial direction of a rotating shaft 108A of the cleaning roller 108, and are formed at a predetermined interval in the rotation direction of the rotating shaft 108A.

Meanwhile, the steps of this modification are side surface portions of recesses. The steps 108E are the side surface portions of the recesses formed on the outer peripheral surface of the cleaning roller 108, and are steps that face the rotation direction of the cleaning roller 108.

The steps 108E are not formed of cut portions unlike in the exemplary embodiment of the invention and the first to fourth modifications.

This operation is the same as the operation of the exemplary embodiment of the invention.

Figure 8C:
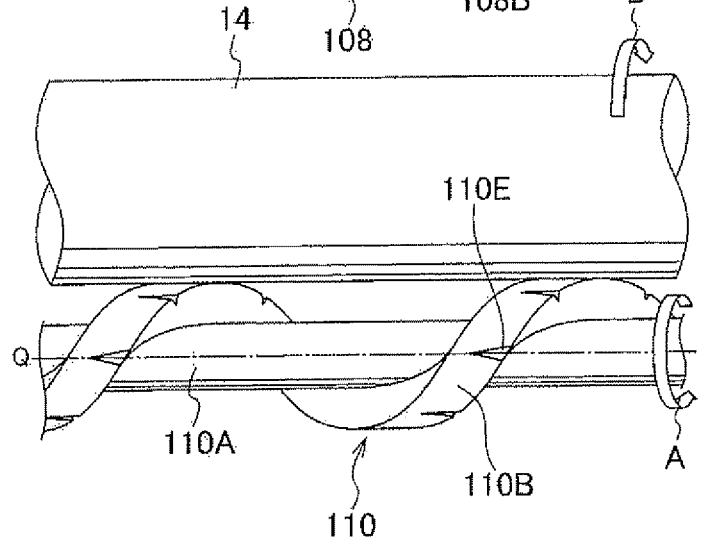

Sixth Modification: FIG. 8C

Next, a sixth modification of the exemplary embodiment of the invention will be described mainly using the differences between the sixth modification and the cleaning members, the charging devices, the assemblies, and the image forming apparatuses according to the first to fifth modifications and the exemplary embodiments of the invention.

FIG. 8C is a cross-sectional view showing a state where a cleaning roller 110 as a sixth modification of the cleaning member according to the exemplary embodiment of the invention comes into contact with a charging roller 14.

Cut portions 110E are formed on the outer peripheral surface of the cleaning roller 110, but the cut portions 110E are formed at one end portion of a spiral portion 110B in a width direction unlike in the exemplary embodiment of the invention and the first to fourth modifications. Further, one side of the cut portion 110E, which is positioned on the upstream side in the rotation direction of the cleaning roller 110, faces the rotation direction of the rotating shaft 110A of the cleaning roller 110 at the contact portion that comes into contact with the charging roller 14, and shows an example of a step.

This operation also is the same as the operation of the exemplary embodiment of the invention.

Method of Manufacturing Cleaning Member According to Exemplary Embodiment of Invention First Method of Manufacturing Cleaning Member According to Exemplary Embodiment of Invention: FIGS. 9A, 9B, 9C, 9D, 9E, and 9F Next, a first method of manufacturing a cleaning member (cleaning roller) according to an exemplary embodiment of the invention will be described.

FIGS. 9A, 9B, 9C, 9D, 9E, and 9F are views illustrating processes for manufacturing a cleaning roller 114. The cleaning roller 114 is manufactured in the order of FIG. 9A to FIG. 9D. Description will be made below in the order of the manufacturing processes.

Figure 9A:
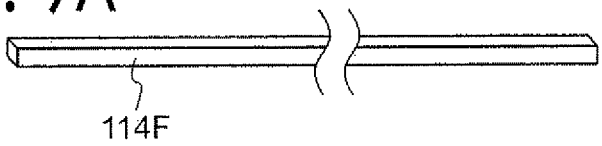
FIGS. 9A, 9B, 9C, 9D, 9E, and 9F are views illustrating processes for manufacturing a cleaning member according to an exemplary embodiment of the invention.
Figure 9B:
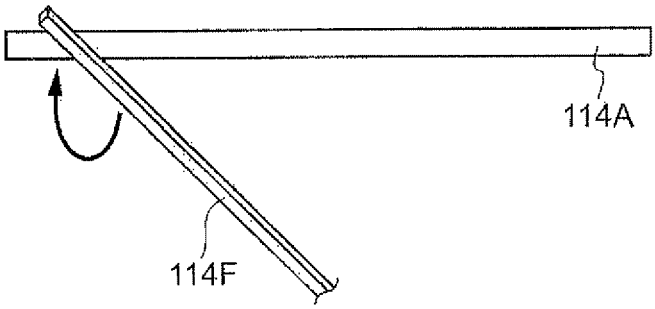
Figure 9C:
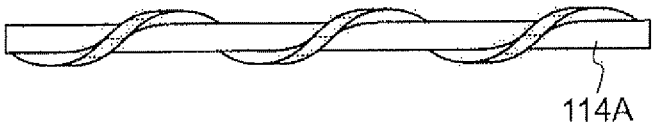
Figure 9E:
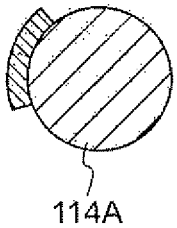
Figure 9D:
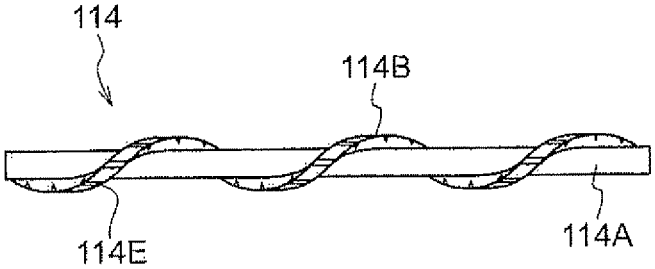
Figure 9F:
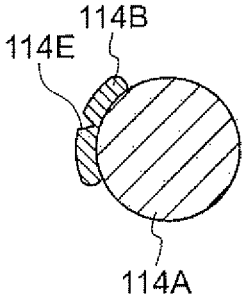

First of all, a strip-like foam body 114F is prepared (FIG. 9A). Next, an adhesive (not shown) is applied to one end face of the foam body 114F, and the foam body 114F is spirally wound on a prepared rotating shaft 114A (FIG. 9B). After that, both end portions of the other end face of the foam body 114F, which is spirally formed on the rotating shaft 114A, in the width direction are chamfered, and a plurality of cut portions 114E parallel to the axial direction of the rotating shaft 114A are formed (FIGS. 9C and 9E). The cleaning roller 114 is manufactured by these processes (FIGS. 9D and 9F).

According to this manufacturing method, the above-mentioned cleaning roller 102 according to the first modification of the exemplary embodiment of the invention can be manufactured. Further, if one end portion of the foam body 114F in the width direction is chamfered, the above-mentioned cleaning roller 100 according to the exemplary embodiment of the invention can be manufactured.

Meanwhile, in the above-mentioned first manufacturing method, both end portions of the foam body 114F in the width direction have been chamfered after the foam body 114F is wound on the rotating shaft 114A. However, chamfering may be performed before the foam body 114F is wound on the rotating shaft 114A. Further, chamfering may be performed after the plurality of cut portions 114E parallel to the axial direction of the rotating shaft 114F are formed.

Furthermore, chamfering may be so-called C chamfering or R chamfering. As in the above-mentioned cleaning roller 100, one end portion, which is gradually separated from the contact portion 100J toward one end portion of both end portions of the contact portion 100J in the width direction, may be formed by chamfering.

In the processes for manufacturing the cleaning roller 114, the cut portions 114E are formed on the upper surface of the foam body 114F while the foam body 114F is wound on the rotating shaft 114A (FIGS. 9B and 9C). Since the cut portions 114E are formed so that the outer peripheral surface of the foam body 114F is pulled due to a difference between the circumferential length of the inner periphery of the foam body and the circumferential length of the outer periphery of the foam body, the cut portions 114E are further opened toward the outer peripheral surface from the rotating shaft 114A (FIG. 9F). Meanwhile, one side of the cut portion 114E, which is positioned on the upstream side in the rotation direction of the cleaning roller 114, faces the rotation direction of the rotating shaft 114A of the cleaning roller 114 at the contact portion that comes into contact with the charging roller 14, and shows an example of a step. Further, the cleaning roller 114, which is manufactured by the first manufacturing method, has the same operation as the operations of the above-mentioned cleaning rollers 100 and 102.

Second Method of Manufacturing Cleaning Member According to Exemplary Embodiment of Invention: FIGS. 10A, 10B, 10C, 10D, and 10E Next, a second method of manufacturing a cleaning member (cleaning roller) according to an exemplary embodiment of the invention will be described.

FIGS. 10A, 10B, 10C, 10D, and 10E are views illustrating processes for manufacturing a cleaning roller 116. The cleaning roller 116 is manufactured in the order of FIG. 10A to FIG. 10D. Description will be made below in the order of the manufacturing processes.

Figure 10A:
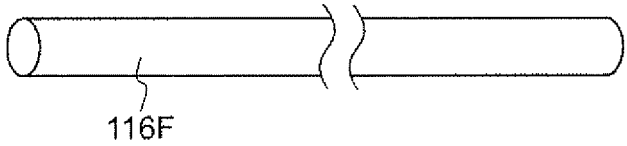
FIGS. 10A, 10B, 10C, 10D, and 10E are views illustrating other processes for manufacturing a cleaning member according to an exemplary embodiment of the invention.
Figure 10B:
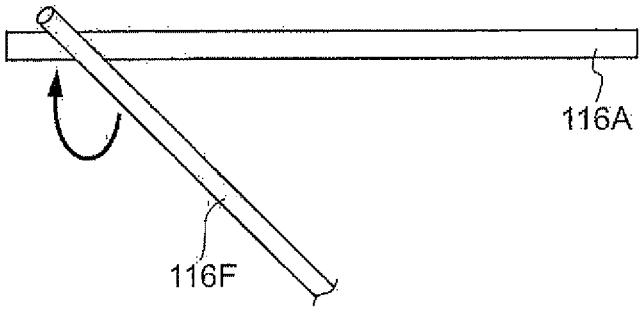
Figure 10C:
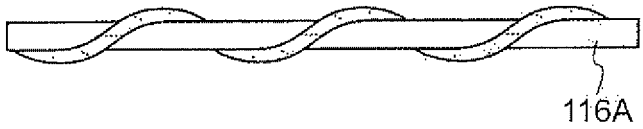
Figure 10D:
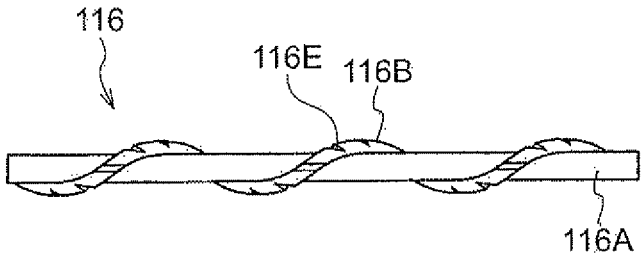
Figure 10E:
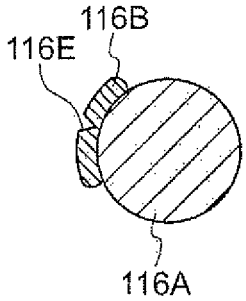

First of all, a cylindrical foam body 116F is prepared (FIG. 10A). Next, an adhesive (not shown) is applied to a part of the foam body 116F, and the foam body 116F is spirally wound on a prepared rotating shaft 116A (FIG. 10B). After that, a plurality of cut portions 116E parallel to the axial direction of the rotating shaft 116A are formed on the curved outer peripheral surface of the foam body 116F that is spirally formed on the rotating shaft 116A (FIG. 10C). The cleaning roller 116 is manufactured by these processes (FIGS. 10D and 10F).

According to this manufacturing method, the chamfering process (FIG. 9C) of the first method of manufacturing the cleaning member according to the exemplary embodiment of the invention is omitted. Meanwhile, the cylindrical foam body has been used as the foam body 116F in the description, but a semi-cylindrical foam body may be used as the foam body 116F. In this case, an adhesive is applied to the flat surface of the foam body and the foam body is wound on the rotating shaft 116A so that the cylindrical portion of the foam body becomes the outer peripheral surface thereof. As a result, a cleaning roller can be manufactured.

Meanwhile, one side of the cut portion 116E, which is positioned on the upstream side in the rotation direction of the cleaning roller 116, faces the rotation direction of the rotating shaft 116A of the cleaning roller 116 at the contact portion that comes into contact with the charging roller 14, and shows an example of a step. Further, the cleaning roller 116, which is manufactured by the second manufacturing method, has the same operation as the operations of the above-mentioned cleaning rollers 100 and 102.

Third Method of Manufacturing Cleaning Member According to Exemplary Embodiment of Invention: FIGS. 11A, 11B, 11C, 11D, and 11E Next, a third method of manufacturing a cleaning member (cleaning roller) according to an exemplary embodiment of the invention will be described.

FIGS. 11A, 11B, 11C, 11D, and 11E are views illustrating processes for manufacturing a cleaning roller 118. The cleaning roller 118 is manufactured in the order of FIG. 11A to FIG. 11D. Description will be made below in the order of the manufacturing processes.

Figure 11A:
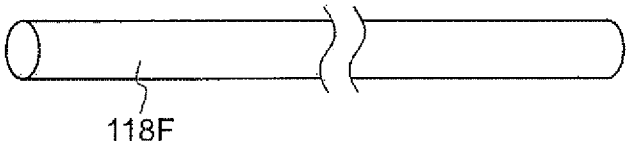
FIGS. 11A, 11B, 11C, 11D, and 11E are views illustrating other processes for manufacturing a cleaning member according to an exemplary embodiment of the invention.
Figure 11B:
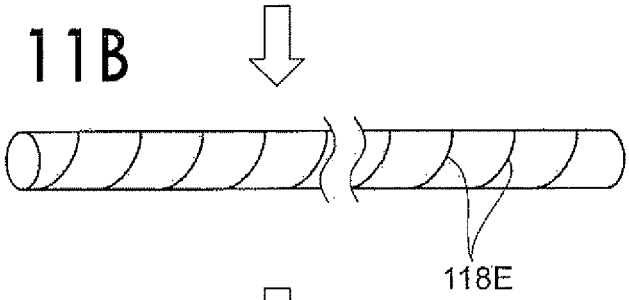
Figure 11C:
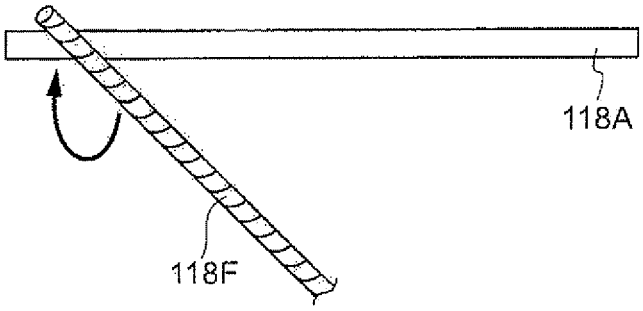
Figure 11D:
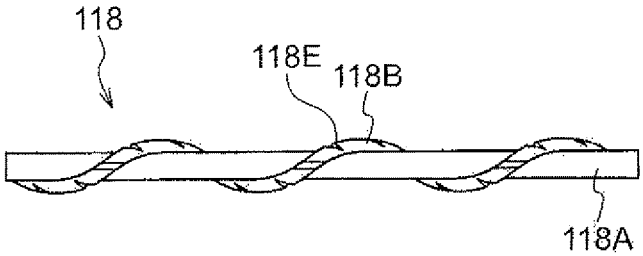

First of all, a cylindrical foam body 118F is prepared (FIG. 11A). Next, a plurality of cut portions 118E, which are inclined with respect to the axial direction of the foam body 118F, are formed on the foam body 118F at a predetermined interval (FIG. 11B). After that, an adhesive (not shown) is applied to a part of the foam body 118F, and the foam body 118F is spirally wound on a prepared rotating shaft 118A so that the cutting direction of the cut portion 118E is parallel to the axial direction of the rotating shaft 118A (FIG. 110). The cleaning roller 118 is manufactured by these processes (FIGS. 11D and 11F).

Meanwhile, one side of the cut portion 118E, which is positioned on the upstream side in the rotation direction of the cleaning roller 118, faces the rotation direction of the rotating shaft 118A of the cleaning roller 118 at the contact portion that comes into contact with the charging roller 14, and shows an example of a step. Further, the cleaning roller 118, which is manufactured by the third manufacturing method, has the same operation as the operations of the above-mentioned cleaning rollers 100 and 102.

Fourth Method of Manufacturing Cleaning Member According to Exemplary Embodiment of Invention: FIGS. 12A, 12B, 12C, 12D, 12E, and 12F Next, a fourth method of manufacturing a cleaning member (cleaning roller) according to an exemplary embodiment of the invention will be described.

FIGS. 12A, 12B, 12C, 12D, 12E, and 12F are views illustrating processes for manufacturing a cleaning roller 120. The cleaning roller 120 is manufactured in the order of FIG. 12A to FIG. 12D. Description will be made below in the order of the manufacturing processes.

Figure 11E:
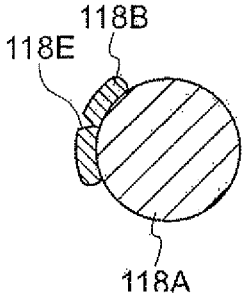
Figure 12A:
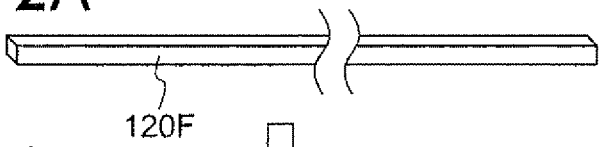
FIGS. 12A, 12B, 12C, 12D, 12E, and 12F are views illustrating other processes for manufacturing a cleaning member according to an exemplary embodiment of the invention.
Figure 12B:
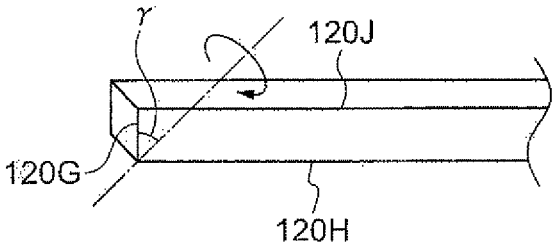
Figure 12C:
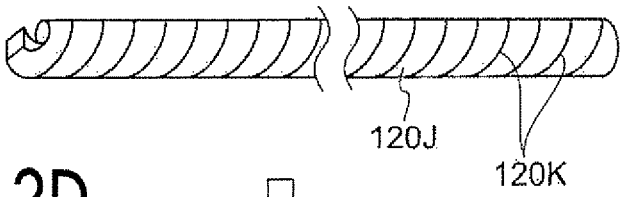
Figure 12D:
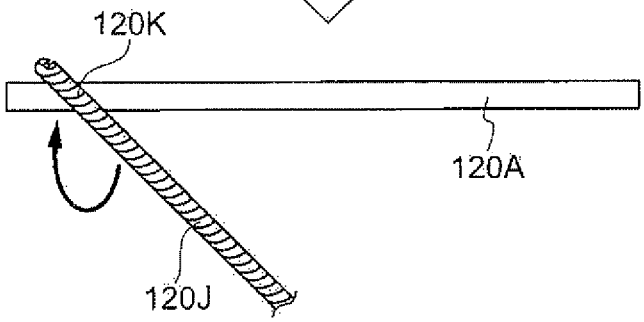

First of all, a strip-like foam body 120F, which is an example of a strip, is prepared (FIG. 12A). Next, a deformed body 120J (a deformed body of the strip-like foam body 120F) is prepared by repeatedly winding an arbitrary short side 120G of the strip-like foam body 120F so that long sides 120H and 120I adjacent to the short side 120G overlap each other in a direction S that forms an acute angle $\gamma$ with respect to the short side 120G (FIGS. 12B and 12C). In this case, a spiral line 120K is formed on the deformed body 120J. The line 120K corresponds to a portion of the strip-like foam body 120F where the long sides 120H and 120I overlap with each other (FIGS. 12B and 12C). Next, the spiral line 120K of the foam body 120J is spirally wound on the outer peripheral surface of the rotating shaft 120A so as to be parallel to the axial direction of a prepared rotating shaft 120A (FIG. 12D). Accordingly, the spiral line 120K of the deformed body 120J forms a step 120E that is opened along the rotating shaft 120A. In this case, an adhesive is applied to a contact portion of the deformed body 120J coming into contact with the rotating shaft 120A, and the deformed body 120J is bonded to the rotating shaft (FIG. 120). The cleaning roller 120 is manufactured by these processes (FIGS. 11E and 11F).

Meanwhile, the "strip-like" mentioned here does not need to mean the shape of an exact rectangular parallelepiped. Further, each of the "short side" and the "long side" does not need to mean an exact side that is formed by surfaces, and may be a round portion. When a cleaning roller is manufactured according to the above-mentioned fourth manufacturing method, a step may be formed as in the cleaning roller 120.

According to this manufacturing method, the chamfering process (FIG. 9C) of the first method of manufacturing the cleaning roller according to the exemplary embodiment of the invention is omitted. Further, the processes (FIGS. 9C, 10C, and 11B) for forming the cut portions in the first to third methods of manufacturing the cleaning roller according to the exemplary embodiment of the invention are also omitted. In other words, the cleaning roller 120 is produced without these cutting processes.

Furthermore, the height of the step 120E of the cleaning roller 120 corresponds to the thickness of the strip-like foam body 120F that is not yet bent. In the cases of the cleaning roller 114 of the above-mentioned first manufacturing method of the invention, the cleaning roller 116 of the second manufacturing method of the invention, and the cleaning roller 118 of the third manufacturing method of the invention, the foam body is separated into pieces when the cut portions are formed to the thickness of the foam body. Accordingly, the depths of these cut portions are smaller than the thickness of the foam body. Therefore, the deep step 120E is formed on the cleaning roller 120.

Meanwhile, one side of the step 120E, which is positioned on the upstream side in the rotation direction of the cleaning roller 120, faces the rotation direction of the rotating shaft 120A of the cleaning roller 120 at the contact portion that comes into contact with the charging roller 14, and shows an example of a step. Further, other operations of the cleaning roller 120, which is manufactured by the fourth manufacturing method, are the same as the operations of the above-mentioned cleaning rollers 100 and 102.

Meanwhile, specific exemplary embodiments of the invention have been described in detail. However, the invention is not limited to the exemplary embodiments, and may include various other exemplary embodiments in the scope of the invention. For example, the charging roller 14 may be provided with a conductive resin layer on a rotating shaft, and may be disposed so as not to come into contact with the surface of the photoreceptor drum 12. Further, in another exemplary embodiment of the invention, a photoreceptor drum may be used as a body to be cleaned and a cleaning roller may come into contact with the surface of the photoreceptor drum to remove foreign materials, such as toner, external additives, and paper powder, remaining on the surface of the photoreceptor drum 12.

EXAMPLES

Hereinafter, cleaning rollers and charging rollers as examples are produced using the respective examples and comparative examples. Further, charging devices of the respective examples and comparative examples are produced and the cleaning performance of cleaning rollers are evaluated.

First Example

Cleaning Roller

A cleaning roller of a first example is produced using the processes for manufacturing the cleaning roller 120 of the fourth method of manufacturing of the cleaning member according to the exemplary embodiment of the invention.

A urethane material (EP70 manufactured by Inoac Corporation) formed by heating and curing a urethane resin, which is obtained by mixing polyether with isocyanate, so as to have a three-dimensional network structure is sliced in the form of a sheet having a thickness of 2.35 mm and is cut into the shape of a strip having a width of 6 mm and a length of 232 mm (the shortest length). A deformed body of a strip-like foam body is produced using a strip sheet of this foam body according to the processes for manufacturing the cleaning roller 120 of the above-mentioned fourth manufacturing method.

Figure 12E:
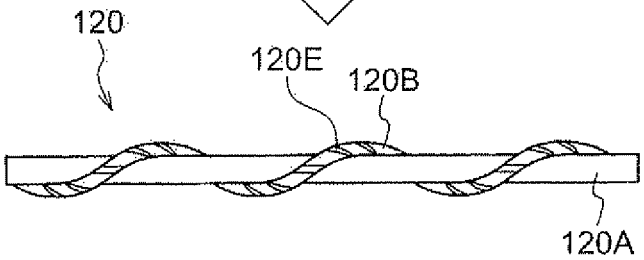
Figure 12F:
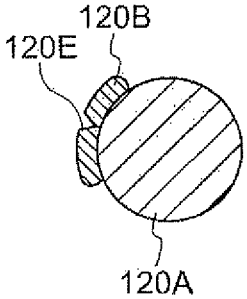

Next, a rotating shaft (SUS304, an outer diameter of 5 mm, and a length of 230 mm) is prepared as a shaft body, the deformed body of the above-mentioned strip-like foam body is wound on the rotating shaft, and both end portions of the foam body in the longitudinal direction are fixed to the shaft body by heat welding. In this case, the ridge portion of a strip sheet of the original foam body in the longitudinal direction is made parallel to the shaft body. A cleaning roller is obtained in this way. Meanwhile, the depth, which is measured after winding, of the step, which has a function of scraping the foreign materials off the surface of a charging roller, among the steps parallel to the shaft is 2.1 mm, an interval between the steps is 2 mm, an overlap L2 between the steps in the direction of the rotating shaft is 3 mm, and the thickness of a spiral portion of the cleaning roller from the outer peripheral surface of the rotating shaft is 4.2 mm. Further, both end portions of the outer peripheral surface of the spiral portion in the width direction have a shape without a corner as shown in FIG. 12E.

Charging Roller 3 parts by weight of an ion conducting agent PEL-100 (manufactured by Japan Carlit Co., Ltd.) are added to 100 parts by weight of epichlorohydrin rubber, a mixture is sufficiently kneaded, and the mixture is extruded and molded. Then, after a SUM-Ni rotating shaft (which is formed by plating sulfur free-cutting steel with nickel), which has an outer diameter of 6 mm and a length of 240 mm, is inserted into the extruded and molded mixture and forming and vulcanization are performed by a press forming machine, polishing is performed and machining is performed so that the outer diameter of an end portion of the roller becomes 8.95 mm and the outer diameter of a middle portion of the roller becomes 9.00 mm. Next, the end portion is cut so that the length of the rubber is 215 mm. After that, a fluorine-based resin is applied to the surface of the roller so as to have a thickness of 5 μm by a dip-coating method, so that a charging roller is produced.

Evaluation

The cleaning roller and the charging roller, which are produced as described above, are assembled into a process cartridge of C3110cn, which is manufactured by DELL, together with exclusive bearings (made of conductive polyoxymethylene) that determine the depth of a bitten portion between the cleaning roller and the charging roller; and are mounted on the C3110cn that is manufactured by DELL and continuous printing test is performed.

Meanwhile, as for a method of mounting the cleaning roller and the charging roller, a distance between the axes of the cleaning roller and the charging roller is fixed so that the middle portion of the cleaning roller in the axial direction bites the charging roller at a depth of 0.3 mm, and the cleaning roller is mounted so as to be rotated by the charging roller. Then, evaluation (print test) is performed.

While an instruction of a job corresponding to one sheet member is sent and rotation is intermittently performed, this evaluation is performed. The cleaning performance of the steps of the cleaning roller, which are parallel to the axial direction of the rotating shaft, is evaluated on the basis of the presence or absence of a color point that is generated when an adhering material having a large particle size remains on the charging roller. Further, the cleaning performance of both ends of the spiral portion is evaluated on the basis of density unevenness that is caused by the volume of a material adhering to the charging roller. If the above-mentioned color point or density unevenness is generated when 500000 sheet members or less are printed, D is marked. If a problem does not occur in image quality until the number of printed sheets exceeds 500000, C (good) B (better than C), or A (better than B) is marked according to the degree of image quality. The respective items are visually evaluated, and a synthetic judgment when either of them corresponds to D is defined as rejection and a synthetic judgment when a result equal to or better than C is obtained is defined as acceptance. Results are shown in Table 1.

Second Example

A cleaning roller of a second example is produced using the processes for manufacturing the cleaning roller 118 of the third method of manufacturing of the cleaning member according to the exemplary embodiment of the invention.

A cylindrical foam body, which has an outer diameter of 4.5 mm and a length of 232 mm, is prepared using the urethane material of the first example. A plurality of cut portions are formed on the surface of the cylindrical foam body at the same interval as the interval between the steps in the rotation direction of the rotating shaft of the first example. The cylindrical foam body on which the plurality of cut portions have been formed is wound on the shaft body in the same manner as the first example, so that a cleaning roller is produced. The depth of the cut portion of the cleaning roller parallel to the rotating shaft, which is measured after winding, is 1.8 mm and the thickness of the spiral portion of the cleaning roller 100 is 3.6 mm. Further, both end portions of the outer peripheral surface of the spiral portion in the width direction have a shape without a corner as shown in FIG. 11D.

The same evaluation as the first example is performed using the cleaning roller that is produced in this way and the charging roller that is produced under the same conditions as the first example. Results are shown in Table 1.

Third Example

A cleaning roller of a third example is produced using the processes for manufacturing the cleaning roller 116 of the second method of manufacturing of the cleaning member according to the exemplary embodiment of the invention.

A cylindrical foam body, which has an outer diameter of 4.5 mm and a length of 232 mm, is prepared using the urethane material of the first example. After the foam body is wound on a shaft body in the same manner as the first example, a plurality of cut portions are formed at the same interval as the interval between the steps in the rotation direction of the rotating shaft of the first example. Accordingly, a cleaning roller is produced. The depth of the cut portion of the cleaning roller parallel to the rotating shaft, which is measured after the cut portions are formed, is 1.8 mm and the thickness of a spiral portion is 3.6 mm. Further, both end portions of the outer peripheral surface of the spiral portion in the width direction have a shape without a corner as shown in FIG. 10D.

The same evaluation as the first example is performed using the cleaning roller that is produced in this way and the charging roller that is produced under the same conditions as the example. Results are shown in Table 1.

Fourth Example

A cleaning roller of a fourth example is produced using the processes for manufacturing the cleaning roller 114 of the fourth method of manufacturing of the cleaning member according to the exemplary embodiment of the invention.

The strip sheet of the foam body of the first example is wound on the same rotating shaft as the first example. After that, the additional machining is performed on the wound foam body as described below. First of all, the ridge portion of the strip sheet in the longitudinal direction is chamfered (is ground by a single-edged knife), and corners of both end portions of the spiral portion in the width direction are machined so as to be rounded. Next, cut portions parallel to the rotating shaft are formed on the spiral portion of the cleaning roller. The plurality of cut portions are formed at the same interval as the interval between the steps in the rotation direction of the rotating shaft of the first example. A cleaning roller is produced in this way. Meanwhile, the depth of the cut portion of the finished cleaning roller parallel to the rotating shaft is 1.5 mm, and the thickness of the spiral portion is 2.1 mm.

The same evaluation as the first example is performed using the cleaning roller that is produced as described above and the charging roller that is produced under the same conditions as the first example. Results are shown in Table 1.

First Comparative Example

The strip sheet of the foam body of first example is wound on a rotating shaft as in the first example, so that a cleaning roller is produced. Cut portions or steps are not formed on the outer peripheral surface of the finished cleaning roller, and the thickness of an elastic layer is 2.1 mm. Both end portions of the outer peripheral surface of the spiral portion in the width direction have corners.

Second Comparative Example

The strip sheet of the foam body of first example is wound on a rotating shaft as in the first example, so that a spiral portion of a cleaning roller is produced. After that, the spiral portion is additionally machined as described below. The ridge of the strip sheet in the longitudinal direction is chamfered (is ground by a single-edged knife), and corners of both ends of the spiral portion in the width direction are machined so as to be rounded. A cleaning roller is obtained in this way. Meanwhile, cut portions or steps are not formed on the outer peripheral surface of the finished cleaning roller, and the thickness of the spiral portion is 2.1 mm.

The same evaluation as the first example is performed using the cleaning roller that is produced in this way and the charging roller that is produced under the same conditions as the first example. Results are shown in Table 1.

Third Comparative Example

The strip sheet of the foam body of first example is wound on a rotating shaft as in the first example, so that a spiral portion of a cleaning roller is produced. After that, the spiral portion is additionally machined as described below. Cut portions parallel to the rotating shaft are formed on the spiral portion of the cleaning roller. The plurality of cut portions are formed at the same interval as the interval between the steps in the rotation direction of the rotating shaft of the first example. A cleaning roller is produced in this way. The depth of the cut portion of the finished cleaning roller parallel to the rotating shaft is 1.8 mm, and the thickness of the spiral portion is 2.1 mm. Both end portions of the spiral portion in the width direction have corners.

The same evaluation as the first example is performed using the cleaning roller that is produced in this way and the charging roller of the first example. Results are shown in Table 1.

TABLE 1

| Example, comparative example | Color point | Judgment | Density unevenness | Judgment | Synthetic judgment |
|---|---|---|---|---|---|
| First example | Not generated until the number of printed sheets becomes 1000000 | A | Not generated until the number of printed sheets becomes 1000000 | A | acceptance |
| Second example | Not generated until the number of printed sheets becomes 800000 | B | Not generated until the number of printed sheets becomes 800000 | B | acceptance |
| Third example | Not generated until the number of printed sheets becomes 800000 | B | Not generated until the number of printed sheets becomes 800000 | B | acceptance |
| Fourth example | Not generated until the number of printed sheets becomes 700000 | C | Not generated until the number of printed sheets becomes 700000 | C | acceptance |
| First comparative example | Generated when the number of printed sheets is 200000 | D | Generated when the number of printed sheets is 200000 | D | rejection |
| Second comparative example | Generated when the number of printed sheets is 200000 | D | Not generated until the number of printed sheets becomes 700000 | C | rejection |
| Third comparative example | Not generated until the number of printed sheets becomes 700000 | C | Generated when the number of printed sheets is 200000 | D | rejection |

The same evaluation as the first example is performed using the cleaning roller that is produced in this way and the charging roller that is produced under the same conditions as the first example. Results are shown in Table 1.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member comprising:

a shaft body; and a spiral portion including a contact portion that is formed on an outer peripheral surface of the shaft body, protrudes spirally, and comes into contact with a body to be cleaned with the rotation of the shaft body, cuts that are formed in the contact portion and comprising steps which face a rotational direction of the shaft body, and an end portion comprising a first end portion and a second end portion, the first end portion is positioned on a side where the contact portion comes into contact with the body to be cleaned first in a width direction of the contact portion, and the height of the end portion from the shaft body is gradually reduced from the height of the contact portion so that the second end portion does not come into contact with the body to be cleaned, wherein the steps are formed on the upstream side of cuts, which are formed on the spiral portion, in the rotation direction.

2. The cleaning member according to claim 1, wherein an angle between an axial direction of the shaft body and the cuts is smaller than an angle between the axial direction and the spiral portion.

3. The cleaning member according to claim 1, wherein the cuts are formed to be openings and are further opened toward a portion of the spiral portion, which is close to the contact portion, from a portion of the spiral portion close to the shaft body.

4. The cleaning member according to claim 1, wherein a plurality of the cuts are provided and overlap each other in the axial direction of the shaft body.

5. The cleaning member according to claim 1, wherein the spiral portion is formed by spirally winding a cylindrical foam body, which includes cuts inclined with respect to an axial direction of the cylindrical foam body and formed on the surface at a predetermined interval, in the axial direction of the shaft body, and the cuts formed on the surface of the cylindrical foam body are opened when a deformed body is spirally wound in the axial direction of the shaft body, so that the steps are formed.

6. The cleaning member according to claim 1, wherein the spiral portion is formed by spirally winding the deformed body, which is deformed into a cylindrical shape by being repeatedly wound so that two long sides adjacent to a short side overlap each other in a direction that forms an acute angle with respect to a short side of a strip, in the axial direction of the shaft body, and a portion where two long sides of the deformed body overlap each other is opened when the deformed body is spirally wound in the axial direction of the shaft body, so that the steps are formed.

7. A charging device comprising:

a charging member that charges a surface of an image supporting body; and the cleaning member according to claim 1 that uses the charging member as a body to be cleaned.

8. An assembly comprising:

the charging device according to claim 7; and an image supporting body that is charged by the charging device, wherein the assembly is integrally replaceable in a body of an image forming apparatus.

9. An image forming apparatus comprising:

an image supporting body;

the charging device according to claim 7;

a latent image forming device that forms a latent image on the surface of the image supporting body charged by the charging device;

a developing device that develops the latent image into a toner image with toner; and a transfer device that transfers the toner image to a transfer target.

10. An image forming apparatus comprising:

an image forming section that includes the assembly according to claim 8, forms a latent image on the image supporting body provided in the assembly, develops the latent image into a toner image with toner, and transfers the toner image to a transfer target medium.

11. A cleaning member comprising:

a shaft body; and a spiral portion including a contact portion that is formed on an outer peripheral surface of the shaft body, protrudes spirally, and comes into contact with a body to be cleaned with the rotation of the shaft body, grooves that are formed in a width direction on the contact portion and having a surface that faces a rotation direction of the shaft body, and an end portion comprising a first end portion and a second end portion, the first end portion is positioned on a side where the contact portion comes into contact with the body to be cleaned first in a width direction of the contact portion, and the height of the end portion from the shaft body is gradually reduced from the height of the contact portion so that the second end portion does not come into contact with the body to be cleaned.

* * * * *